United States Patent [19]

Matsumoto et al.

[11] Patent Number: 5,003,937

[45] Date of Patent: Apr. 2, 1991

[54] VALVE OPERATING SYSTEM FOR INTERNAL COMBUSTION ENGINE

[75] Inventors: Yukihiro Matsumoto; Kenji Yoshihara; Tetsuya Kajiura; Tomonori Niizato; Noriyuki Yamada, all of Saitama, Japan

[73] Assignee: Honda Giken Kogyo Kabushiki Kaisha, Tokyo, Japan

[21] Appl. No.: 388,123

[22] Filed: Aug. 1, 1989

[30] Foreign Application Priority Data

Aug. 1, 1988 [JP] Japan ..... 63-102101[U]
Oct. 11, 1988 [JP] Japan ..... 63-132441[U]

[51] Int. Cl.[5] ..... F01L 1/34; F01L 9/02

[52] U.S. Cl. ..... 123/90.12; 123/90.15; 123/90.16

[58] Field of Search ..... 123/90.12, 90.13, 90.15, 123/90.16

[56] References Cited

U.S. PATENT DOCUMENTS

| | | | |
|---|---|---|---|
| 4,111,165 | 9/1978 | Aoyama et al. | 123/90.15 |
| 4,674,451 | 6/1987 | Rembold et al. | 123/90.12 |
| 4,716,863 | 1/1988 | Pruzan | 123/90.12 |
| 4,800,850 | 1/1989 | Yoshida et al. | 123/90.16 |
| 4,854,273 | 8/1989 | Uesugi et al. | 123/90.16 |
| 4,858,574 | 8/1989 | Fukuo et al. | 123/90.16 |

FOREIGN PATENT DOCUMENTS

| | | | |
|---|---|---|---|
| 0025008 | 2/1984 | Japan | 123/90.16 |
| 0025010 | 2/1984 | Japan | 123/90.16 |
| 0126011 | 7/1984 | Japan | 123/90.16 |

OTHER PUBLICATIONS

English translation of Japanese 59-15614(A)-summary sheet.

*Primary Examiner*—Charles J. Myhre
*Assistant Examiner*—Weilun Lo
*Attorney, Agent, or Firm*—Lyon & Lyon

[57] ABSTRACT

In a valve operating system for an internal combustion engine that includes a valve operation mode changing mechanism capable of changing at least one of either the lift amount of opening of an engine valve openably and closably carried in an engine body or the opening or closing timing in accordance with a variation in hydraulic pressure supplied to the changing mechanism. A selector valve is provided and includes a valve element slidably received in a housing attached to the engine body to change the supply of hydraulic pressure to the valve operation mode changing mechanism. The housing of the selector valve is provided with a working oil chamber which receives an oil pressure for driving, toward a position to supply a higher hydraulic pressure to the valve operation mode changing mechanism, a valve element biased toward a position to supply a lower hydraulic pressure to the valve operation mode changing mechanism. The working oil chamber is connected through a leak jet to a drain chamber provided in the engine body. The leak jet permits the hydraulic pressure to be quickly released from the working oil chamber when the valve element of the selector valve is driven to block the communication between the hydraulic pressure supply source and the valve operation mode changing mechanism, thereby leading to a quick changing operation of the valve operation mode changing mechanism.

20 Claims, 17 Drawing Sheets

VALVE OPERATING SYSTEM FOR INTERNAL COMBUSTION ENGINE

BACKGROUND OF THE INVENTION

1. Field of the Invention

The field of the present invention is valve operating systems for internal combustion engines, comprising a valve operation mode changing mechanism capable of changing the amount of lift opening of an engine valve openably and closably carried in an engine body and/or the opening or closing timing to correspond to engine speed for improving the engine operation. The change is accomplished in many systems by a variation in hydraulic pressure supplied to the mechanism by means of a selector valve having a slidable valve element to control the condition for supplying the hydraulic pressure to the valve operation mode changing mechanism.

2. Description of the Prior Art

Such valve operating system has conventionally been known, for example, from Japanese Patent Application Laidopen No. 226216/84 (corresponding to U.S. Pat. No. 4,537,165).

In such a valve operating system, the hydraulic pressure supplied to the valve operation mode changing mechanism is changed to a higher or lower level by a selector valve to operate the valve operation mode changing mechanism, thereby changing the opening and closing mode for the engine valve, and it is desirable that such changing of the hydraulic pressure is conducted quickly to provide a rapid and smooth changing operation of the valve operation mode changing mechanism.

SUMMARY OF THE INVENTION

The present invention has been accomplished with the above circumstances in view, and it is an object of the present invention to provide a valve operating system for an internal combustion engine, wherein the changing operation of the valve operation mode changing mechanism can be quickly and smoothly performed.

To attain the above object, according to a first feature of the present invention, the housing of the selector valve is provided with a working oil chamber which exhibits an oil pressure for driving a valve element toward a position to supply a higher hydraulic pressure to the valve operation mode changing mechanism, which valve element is biased normally toward a position to supply a lower hydraulic pressure to the valve operation mode changing mechanism, and with the working oil chamber being connected through a leak jet to a drain chamber provided in the engine body. With this construction, the valve element is operated by supplying a hydraulic pressure into the working oil chamber in the selector valve, thereby changing the condition for supplying the hydraulic pressure to the valve operation mode changing mechanism, and when the selector valve is operated to change the hydraulic pressure supplied to the valve operation mode changing mechanism to a lower level, the hydraulic pressure in the working oil chamber is released through the leak jet whereby the valve element is returned quickly to the original position and leading to a quick changing operation of the valve operation mode changing mechanism.

According to a second feature of the present invention, an inlet port is provided in the housing of the selector valve to lead to a hydraulic pressure supply source, so that it may be opened and closed by the valve element, and an oil filter is disposed in the inlet port and clamped between the housing and the engine body. With the construction of this second feature, an extremely simple arrangement makes it possible to prevent dirt or other solid materials in a working oil from entering the selector valve to contribute to a stabilization of the operation of the selector valve and also to facilitate the maintenance.

According to a third feature of the present invention, the housing of the selector valve includes an inlet port leading to a hydraulic pressure supply source, an outlet port leading to the valve operation mode changing mechanism, said inlet and outlet ports being provided in locations such that the communication between the inlet and outlet ports is changed over by the movement of the valve element, an oil reservoir provided in communication with the outlet port, and a pressure detector attached to the housing to communicate with the oil reservoir. With the construction of this third feature, the hydraulic pressure supplied to the valve operation mode changing mechanism can be correctly detected from only a hydrostatic pressure to correctly detect the operative condition of the valve operation mode changing mechanism.

According to a fourth feature of the present invention, the housing of the selector valve includes an inlet port leading to a hydraulic pressure supply source, an outlet port leading to the valve operation mode changing mechanism, the inlet and outlet ports being provided in locations such that the communication between the inlet and outlet ports is changed over by the movement of the valve element, and a bypass port provided therein to connect a drain chamber provided in the engine body with the outlet port for selectively being put into and out of communication. With the construction of the fourth feature, by putting the bypass port into communication when the hydraulic pressure supplied to the valve operation mode changing mechanism is changed to a lower level, the hydraulic pressure supplied to the valve operation mode changing mechanism can be quickly reduced to contribute to an increase in the speed of the changing operation of the valve operation mode changing mechanism.

According to a fifth feature of the present invention, the distance "d" between an inner surface of a cylinder bore provided in the housing to slidably receive the valve element therein and an outer surface of the valve element is set to establish a relation: $d/D=0.75$ to $7\times10^{-3}$ wherein "D" is an outside diameter of the valve element. With the construction of the fifth feature, the operational speed of the valve element in the selector valve can be at a higher level of less than 0.1 second, thereby providing an increase in speed of the changing operation of the valve operation mode changing mechanism.

According to a sixth feature of the present invention, the housing of the selector valve is formed of a material having a coefficient of thermal expansion larger than that of the material forming the valve element. With the construction of the sixth feature, the operational speed of the selector valve at higher temperatures can be improved to contribute to an increase in speed of the changing operation of the valve operation mode changing mechanism, and the working oil can be inhibited from leaking between the housing and the valve element to prevent any misoperation.

Further, according to a seventh feature of the present invention, the selector valve is interposed between the hydraulic pressure supply passage leading to the hydraulic pressure supply source and an oil feed passage leading to the valve operation mode changing mechanism, and an enlarged or larger diameter portion is provided at the middle of the hydraulic pressure supply passage. With the construction of the seventh feature, when a relatively large amount of a working oil flows from the hydraulic pressure supply passage into the oil feed passage, a temporary reduction in hydraulic pressure in the hydraulic pressure supply passage can be inhibited by an accumulator chamber effect at an enlarged or larger diameter portion to smooth the changing operation of the valve operation mode changing mechanism.

The above and other objects, features and advantages of the invention will become apparent from the following description of the preferred embodiments and the accompanying drawings.

BRIEF DESCRIPTION OF THE DRAWINGS

FIGS. 1 to 18 illustrate one embodiment of the present invention, wherein:

FIG. 1 is a sectional elevation view of a portion of an internal combustion engine, taken along a line I—I in FIG. 2;

FIG. 2 is a plan view taken along a line II—II in FIG. 1;

FIG. 3 is a sectional elevation view taken along a line III—III in FIG. 2;

FIG. 4 is a sectional plan view taken along a line IV—IV in FIG. 1;

FIG. 5 is a sectional elevation view taken along a line V—V in FIG. 2;

FIG. 6 is an enlarged, sectional plan view taken along a line VI—VI in FIG. 1;

FIG. 7 is a diagrammatic illustration of an oil supply system;

FIG. 8 is an elevation view taken along a line VIII—VIII in FIG. 2;

FIG. 9 is a fragmentary sectional elevation view taken along a line IX—IX in FIG. 8;

FIG. 10 is an enlarged sectional elevation view taken along a line X—X in FIG. 8 with a selector valve closed;

FIG. 11 is a graph illustrating the influence exerted on the operational speed by the clearance between the housing and the valve element in a selector valve;

FIG. 12 is a graph illustrating the influence exerted on the hydraulic pressure of the oil feed passage by the clearance;

FIG. 13 is a graph illustrating the influence exerted on the hydraulic pressure of the oil feed passage by a variation in temperature;

FIG. 14 is a graph illustrating a variation in clearance due to the temperature depending upon the selection of the materials;

FIG. 15 is a schematic cross-sectional view for illustrating the sizes of the cylinder bore and the valve element in the selector valve;

FIG. 16 is a sectional elevation view taken along a line XVI—XVI in FIG. 2;

FIG. 17 is a sectional elevation view similar to FIG. 10, but with the selector valve opened;

FIG. 18 is a graph illustrating results of an experiment concerning the influence exerted on the operational speed by the clearance between the housing and the valve element in the selector valve;

FIGS. 19 and 20 illustrate another embodiment, wherein;

FIG. 19 is a sectional elevation view similar to FIG. 10; and

FIG. 20 is an enlarged view of the portion in the circle indicated by the arrow XX in FIG. 19.

DESCRIPTION OF THE PREFERRED EMBODIMENTS

The present invention will now be described in connection with the two embodiments shown in the accompanying drawings.

Figure 1:
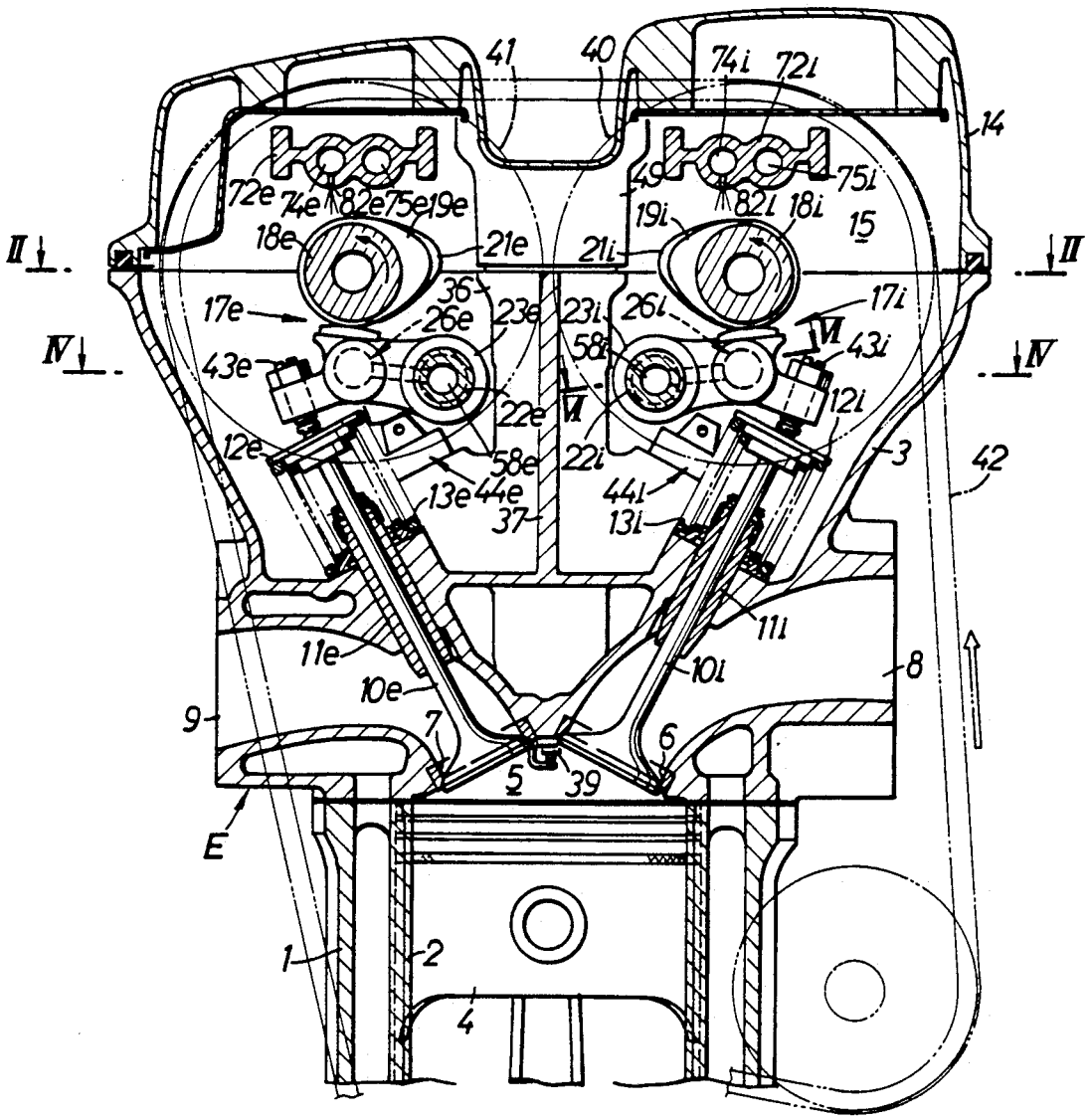
Figure 2:
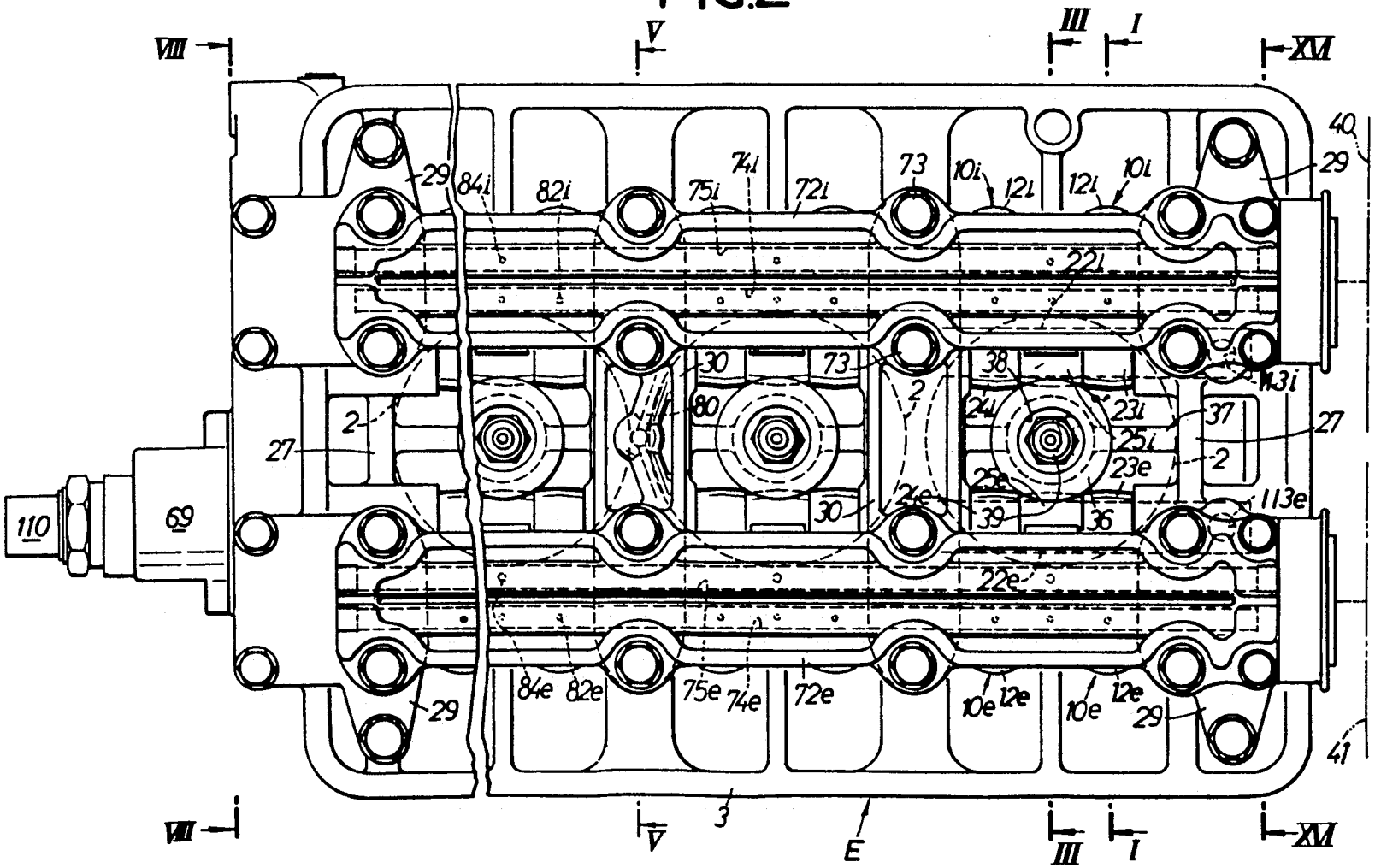

One embodiment of the present invention will first be described with reference to FIGS. 1 to 18. Referring to FIGS. 1 and 2, four cylinders 2 are arranged in a line within a cylinder block in a double overhead cam (DOHC) type multicylinder internal combustion engine and a combustion chamber 5 is defined in each cylinder 2 between a cylinder head 3 mounted on an upper surface of the cylinder block 1 to constitute an engine body E and a piston 4 which is slidably received in each of the cylinders 2. The cylinder head 3 has a pair of intake openings 6 and a pair of exhaust openings 7 provided in a ceiling surface of each of the combustion chambers 5. Each intake opening 6 is connected to an intake port 8 in one side surface of the cylinder head 3, and each exhaust opening 7 is connected to an exhaust port 9 in the other side surface of the cylinder head 3.

Cylindrical guides **11*i* and 11*e* are mounted in the portion of the cylinder head 3 corresponding to each of the cylinders 2 to guide a pair of intake valves 10*i* as engine valves each capable of opening and closing the corresponding intake openings 6 and a pair of exhaust valves 10*e* as engine valves each capable of opening and closing the corresponding exhaust openings 7, respectively. Valve springs 13*i* and 13*e* are provided in compression between the cylinder head 3 and retainer flanges 12*i* and 12*e* provided at upper ends of each intake valve 10*i* and each exhaust valve 10*e* projecting upwardly from the cylindrical guides 11*i* and 11*e*, respectively, so that each intake valve 10*i* and each exhaust valve 10*e* is biased upwardly, i.e., in a closing direction, by the valve springs 13*i* and 13*e***.

A working chamber 15 is defined between the cylinder head 3 and a head cover 14 mounted on an upper surface of the cylinder head 3. Contained and disposed in the working chamber 15 are an intake valve-operating device **17*i* for opening and closing the intake valves 10*i* for each cylinder 2 and an exhaust valve-operating device 17*e* for opening and closing the exhaust valves 10*e* for each cylinder 2. The valve-operating devices 17*i* and 17*e* basically have the same components and construction and hence only one of the valve-operating devices 17*i* and 17*e*** will be described in detail with its parts designated by reference characters suffixed by i or e, and the other device will be only shown in Figures with its parts indicated by e- or i-suffixed reference characters.

Figure 3:
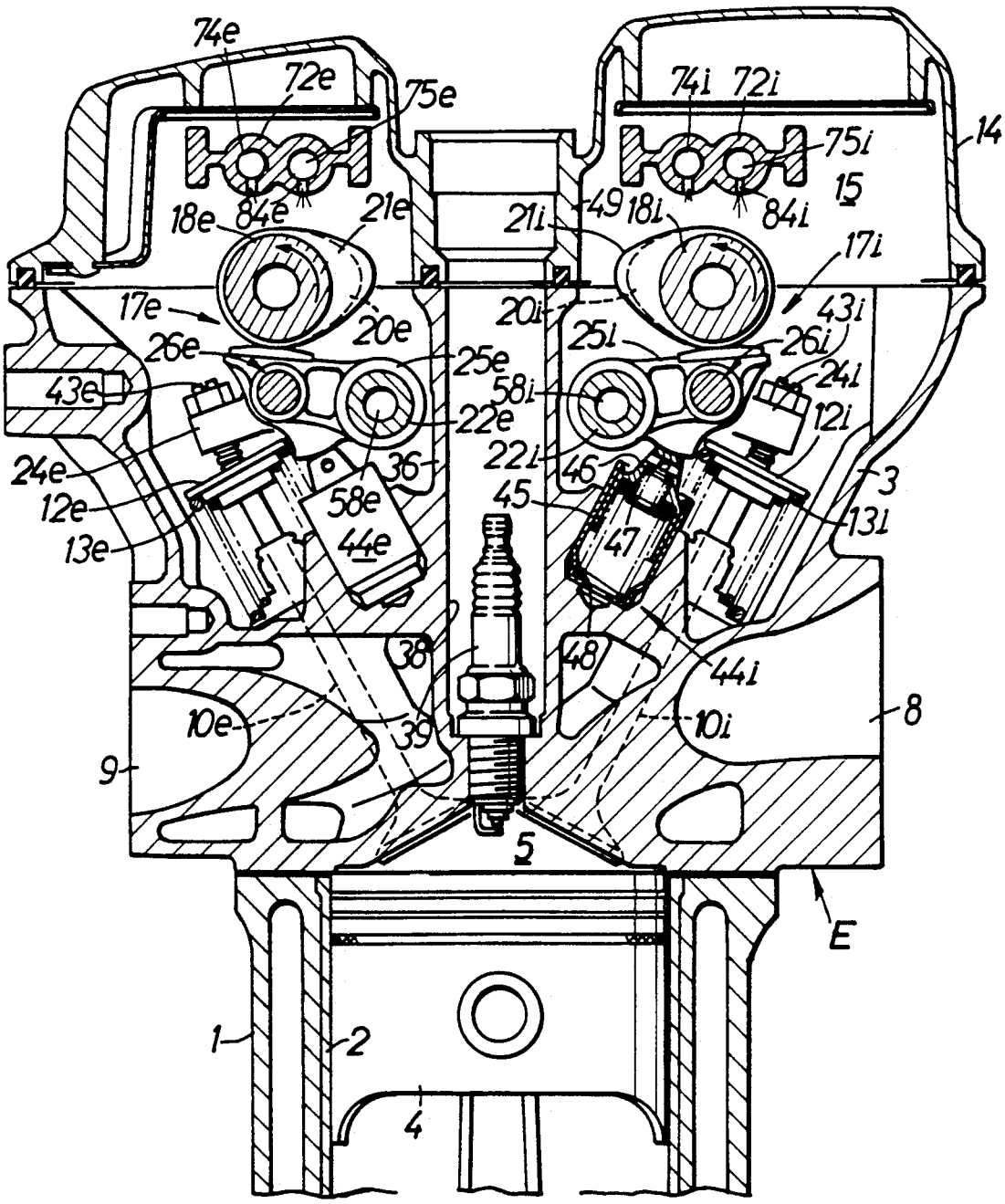
Figure 4:
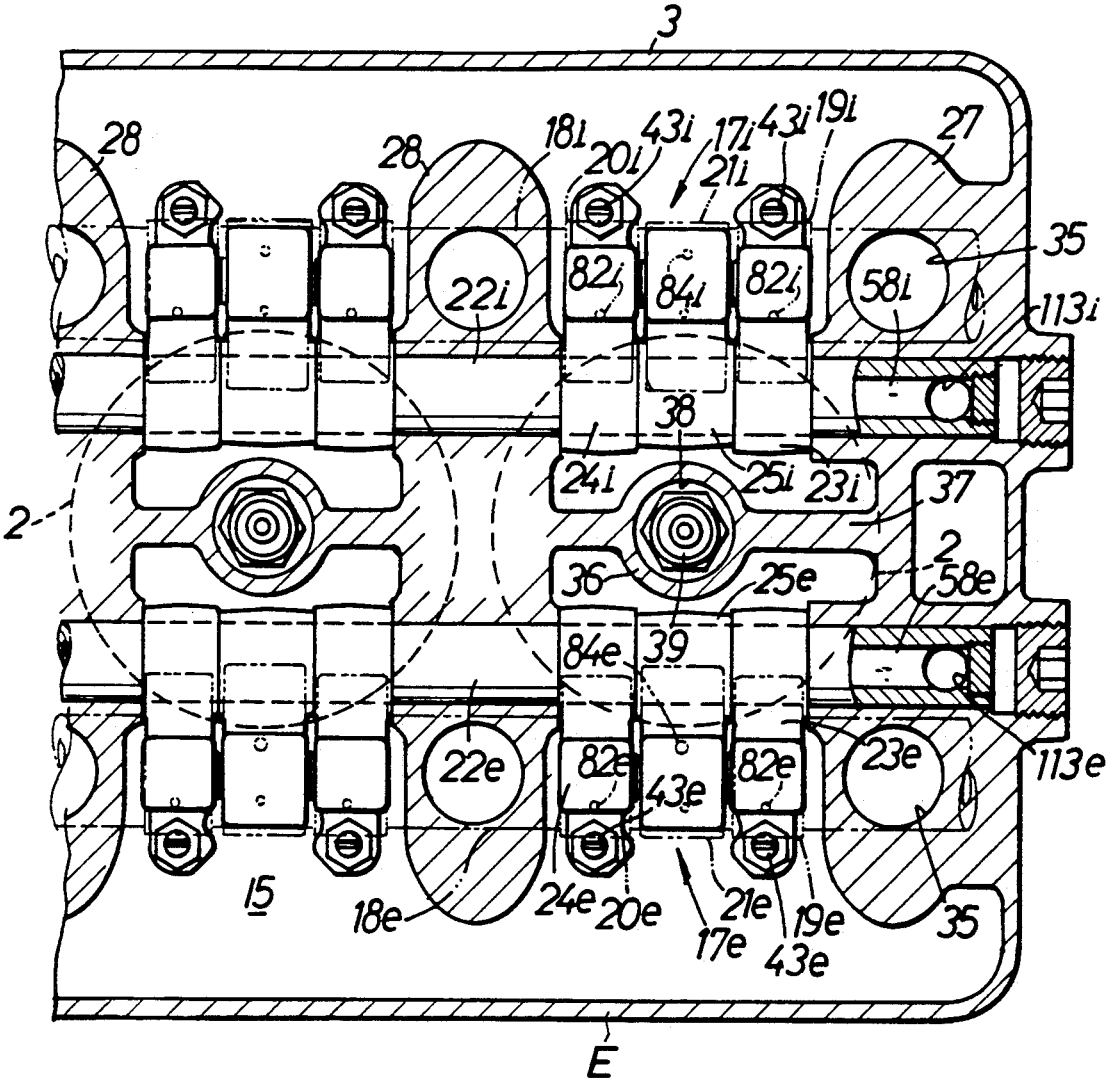

Referring also to FIGS. 3 and 4, the intake valve operating device **17*i* comprises a cam shaft 18*i* which is rotated at a reduction ratio of ½ by an engine crank shaft (not shown), lower-speed cams 19*i* and 20*i* and a higher-speed cam 21*i* which are provided on the cam shaft 18*i* in correspondence to each cylinder 2, a rocker shaft 22*i* fixedly disposed in parallel to the cam shaft 18*i*, a first drive rocker arm 23*i*, a second drive rocker arm 24*i* and a free rocker arm 25i which are pivoted on the rocker shaft 22i in correspondence to each cylinder 2, and a hydraulic valve operation mode changing mechanism 26i provided in the rocker arms 23i, 24i and 25i corresponding to each cylinder 2**.

Figure 5:
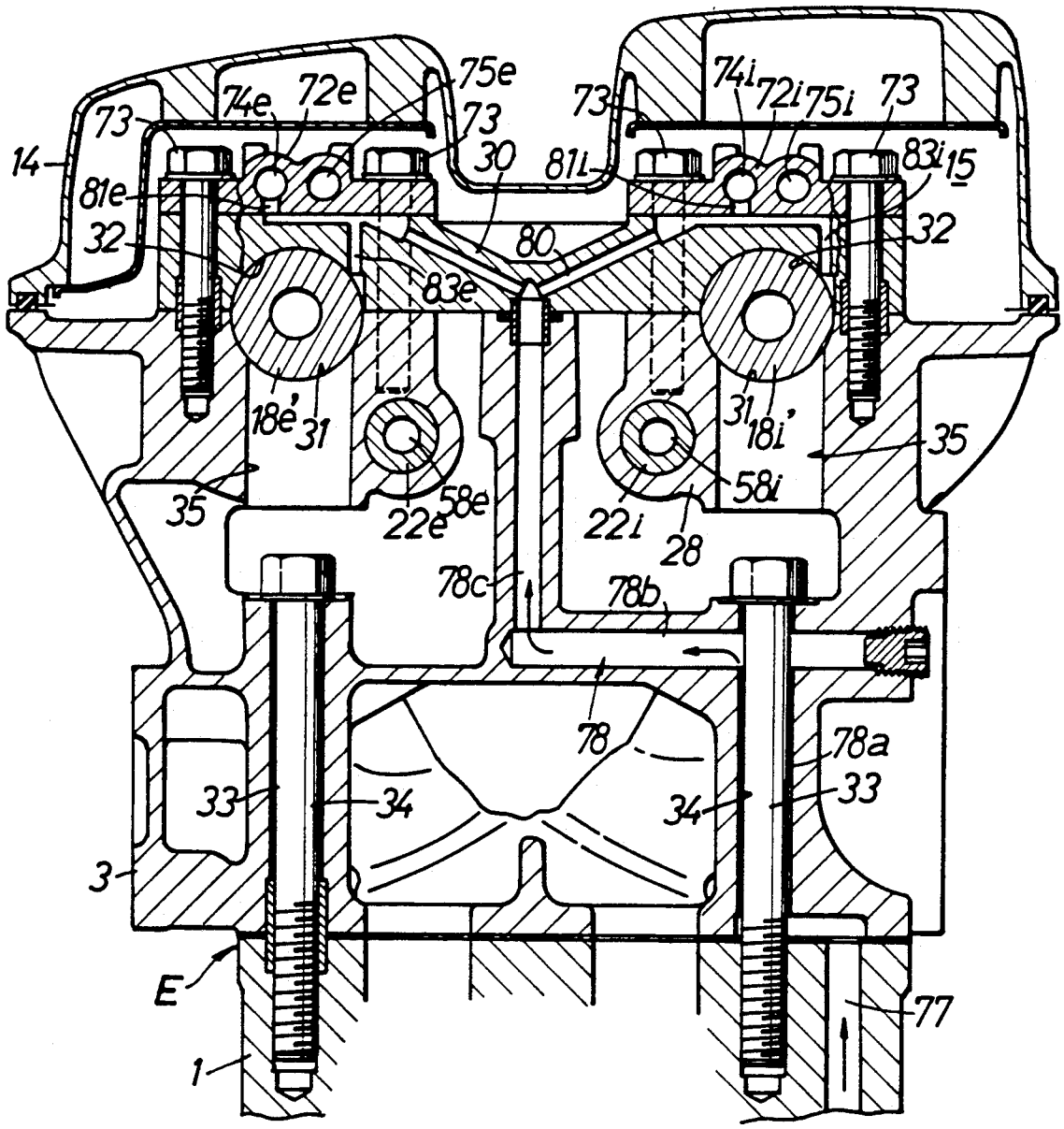

Referring also to FIG. 5, the cam shaft 18i is disposed in parallel to the direction of the arrangement of the cylinders 2 above the cylinder head 3 for rotation about an axis. More specifically, the cylinder head 3 is integrally provided with cam support portions 27 and 27 (see FIG. 2) at its opposite ends in the direction of arrangement of the cylinders 2, and with three cam support portions 28 (see FIG. 4) at locations between the adjacent cylinders 2. The cam shaft 18i is supported for rotation about the axis by the following components: cam holders 29 and 29 locked on the cam support portions 27 at the opposite ends; cam holders 30 locked on the three cam support portions 28; and the cam support portions 27 and 28. The cam holders 29 are independently mounted on the intake valve-operating device 17i and the exhaust valve-operating device 17e, respectively, whereas each of the cam holders 30 are disposed on both the valve-operating devices 17i and 17e. A semi-circular support surface 31 is provided on an upper surface of each of the cam support portions 27 and 28 for supporting an outer peripheral surface of a lower half of the cam shafts 18i, 18e, and a semi-circular support surface 32 is provided on a lower surface of each of the cam holders 29 and 30 for supporting an outer peripheral surface of an upper half of the cam shafts 18i, 18e.

Each of the cam support portions 27 and 28 is provided, at a location corresponding to each of the cam shafts 18i and 18e, with a pair of vertically extending insert holes 34 through each of which is inserted a bolt 33 for clamping the cylinder head 3 to the cylinder block 1 and, at a place directly above and corresponding to each of the insert holes 34, with a vertically extending access hole 35 opened at its upper end in the semicircular support surface 31 for inserting and access to the bolt 33.

At a place corresponding to a central portion of each cylinder 2 and between the cam support portions 27 and 28, a vertically extending cylindrical central block 36 is integrally provided on the cylinder head 3 and connected to the cam support portions 27 and/or 28 on the opposite sides thereof by a support wall 37. The head cover 14 is provided with a cylindrical central block 49 removably connected to the central block 36. A plug inset hole 35 is made in each of the central blocks 36 and 49, and a spark plug 39 is mounted in the plug inset hole 38 to project into the combustion chamber 5.

Timing pulleys 40 and 41 are fixedly mounted at one end of the cam shafts 18i and 18e projecting from the cylinder head 3 and the head cover 14, respectively, and a timing belt 42 passes around the timing pulleys 40 and 41 for transmitting a driving power from a crank shaft (not shown). This causes the cam shafts 18i and 18e to rotate in the same direction.

The lower-speed cams 19i and 20i are integrally provided on the cam shaft 18i at locations corresponding to the intake valves 10i, and the higher-speed cam 21i is integrally provided between the two lower-speed cams 19i and 20i. The rocker shaft 22i is fixedly held below the cam shaft 18i by the cam support portions 27 and 28 to have its axis parallel to the cam shaft 18i. Pivoted on the rocker shaft 22i in an adjacent relation to one another are the first drive rocker arm 23i operatively connected to one of the intake valves 10i, the second drive rocker arm 24i operatively connected to the other intake valve 10i, and the free rocker arm 25i disposed between the first and second drive rocker arms 23i and 24i.

Tappet screws 43i are threadedly inserted in the first and second drive rocker arms 23i and 24i for adjustable movement to abut against upper ends of the corresponding intake valves 10i, whereby the drive rocker arms 23i and 24i are operatively connected to the two intake valves 10i, respectively.

The free rocker arm 25i is biased in a direction to be retained in slide contact with the higher-speed cam 21 by a lost motion mechanism 44i interposed between the cylinder head 3 (see FIG. 3). The lost motion mechanism 44i comprises a bottomed cylindrical guide member 45 fitted in the cylinder head 3 with its closed end turned toward the cylinder head 3, a piston 46 slidably received in the guide member 45 and abutting against a lower surface of the free rocker arm 25i, and a first spring 47 and a second spring 48 interposed in series between the piston 46 and the guide member 45 to bias the piston 46 toward the free rocker arm 25i. The first and second springs 47 and 48 have spring constants of different values.

Figure 6:
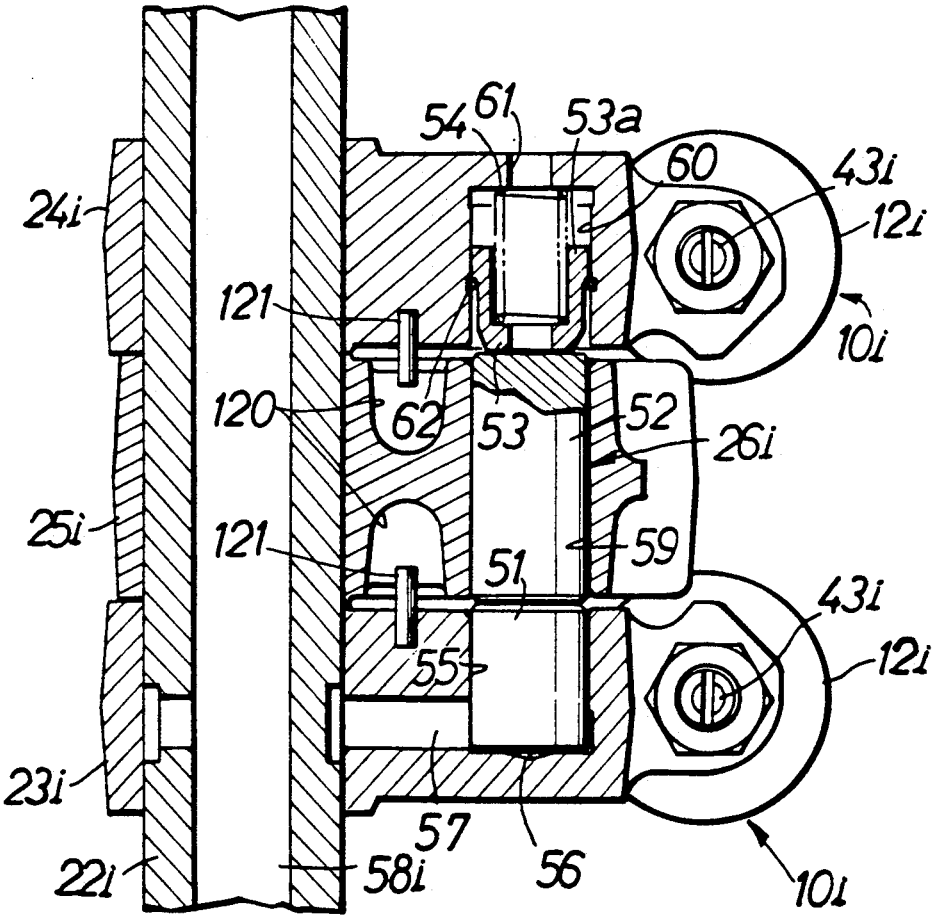

Referring to FIG. 6, the hydraulic valve operation mode changing mechanism 26i comprises a first changing pin 51 capable of connecting the first drive rocker arm 23i and the free rocker arm 25i, a second changing pin 52 capable of connecting the free rocker arm 25i and the second drive rocker arm 24i, a restricting pin 53 for restricting the movement of the first and second changing pins 51 and 52, and a return spring 54 for biasing the pins 51 to 53 toward the disconnecting position.

The first drive rocker arm 23i is provided with a first bottomed guide hole 55 opened toward the free rocker arm 25i in parallel to the rocker shaft 22i and the first changing pin 51, formed into a columnar shape, is slidably received in the first guide hole 55. A hydraulic chamber 56 is defined between one end of the first changing pin 51 and a closed end of the first guide hole 55. The first drive rocker arm 23i is provided with a passage 57 communicating with the hydraulic chamber 56. The rocker shaft 22i is provided with an oil feed passage 58i which is normally in communication with the hydraulic chamber 56 through the passage 57 despite the swinging movement of the first drive rocker arm 23i.

A guide hole 59 corresponding to the first guide hole 55 is provided in the free rocker arm 25i to extend between opposite sides of the free rocker arm 25i in parallel to the rocker shaft 22i and the second changing pin 52, with one end thereof abutting against the other end of the first changing pin 51, is slidably received in the guide hole 59. The second changing pin 52 is also formed into a columnar shape.

A second bottomed guide hole 60 corresponding to the guide hole 59 is provided in the second drive rocker arm 24i parallel to the rocker shaft 22i and opened toward the free rocker arm 25i and the bottomed cylindrical restricting pin 53, abutting against the other end of the second changing pin 52, is slidably received in the second guide hole 60. The restricting pin 53 is disposed with its opened end turned to a closed end of the second guide hole 60, so that an annular portion 53a protruding radially outwardly at such opened end is slidable in the second guide hole 60. The return spring 54 is compressed between the closed end of the second guide hole 60 and a closed end of the restricting pin 53, so that the pins 51, 52 and 53, which are in abutment against one another, are biased toward the hydraulic chamber 56 by the return spring 54. The closed end of the second guide hole 60 is provided with a release hole 61 for venting air and any oil.

A retaining ring 62 is fitted in an inner surface of the second guide hole 60 and engageable with the annular portion 53*a* of the restricting pin 53 so as to inhibit the restricting pin 53 from slipping out of the second guide hole 60. The position of the retaining ring 62 is determined such that the restricting pin 53 is inhibited from being moved further from its point of abutting against the second changing pin 52 in a location between the free rocker arm 25*i* and the second drive rocker arm 24*i* toward the free rocker arm 25*i*.

In such hydraulic valve operation mode changing mechanism 26*i*, an increase in hydraulic pressure in the hydraulic chamber 56 causes the first changing pin 51 to slidably move into the guide hole 59, while causing the second changing pin 52 to slidably move into the second guide hole 60, whereby the rocker arms 23*i*, 25*i* and 24*i* are connected. On the other hand, a decrease in hydraulic pressure in the hydraulic chamber 56 causes the spring force of the return spring 54 to move the first changing pin 51 back to a location in which its abutment face against the second changing pin 52 is located between the first drive rocker arm 23*i* and the free rocker arm 25*i*, while moving the second changing pin 52 back to a location in which its abutment face against the restricting pin 53 is located between the free rocker arm 25*i* and the second rocker arm 24*i*. Thus, the interconnection of the rocker arms 23*i*, 25*i* and 24*i* is released.

The free rocker arm 25*i* has recesses 120, 120 provided in its side faces opposed respectively to the first and second drive rocker arms 23*i* and 24*i* by cutting-away of a wall for reduction in weight and spring pins 121 are pressfitted into and fixed in side faces of the first and second drive rocker arms 23*i* and 24*i* opposed to the recesses 120 to project into the recesses 120, respectively. The amount of relative swinging movement of the first and second drive rocker arms 23*i* and 24*i* is restricted by the recesses 120 and the spring pins 121, but the first and second drive rocker arms 23*i* and 24*i* which are in sliding contact with the lower-speed cams 19*i* and 20*i* and the free rocker arm 25*i* which is in sliding contact with the higher-speed cam 21*i* are still able to swing relative to each other in lower speed operation of the engine. The recesses 120 and 120 are large enough to not cause interference with such relative swinging movement. Moreover, the recesses 120 and the spring pins 121 serve to inhibit the rocker arms 23*i*, 24*i* and 25*i* from being pivoted relative to each other without limitation during maintenance to thereby prevent the first and second changing pins 51 and 52 from falling out.

Figure 7:
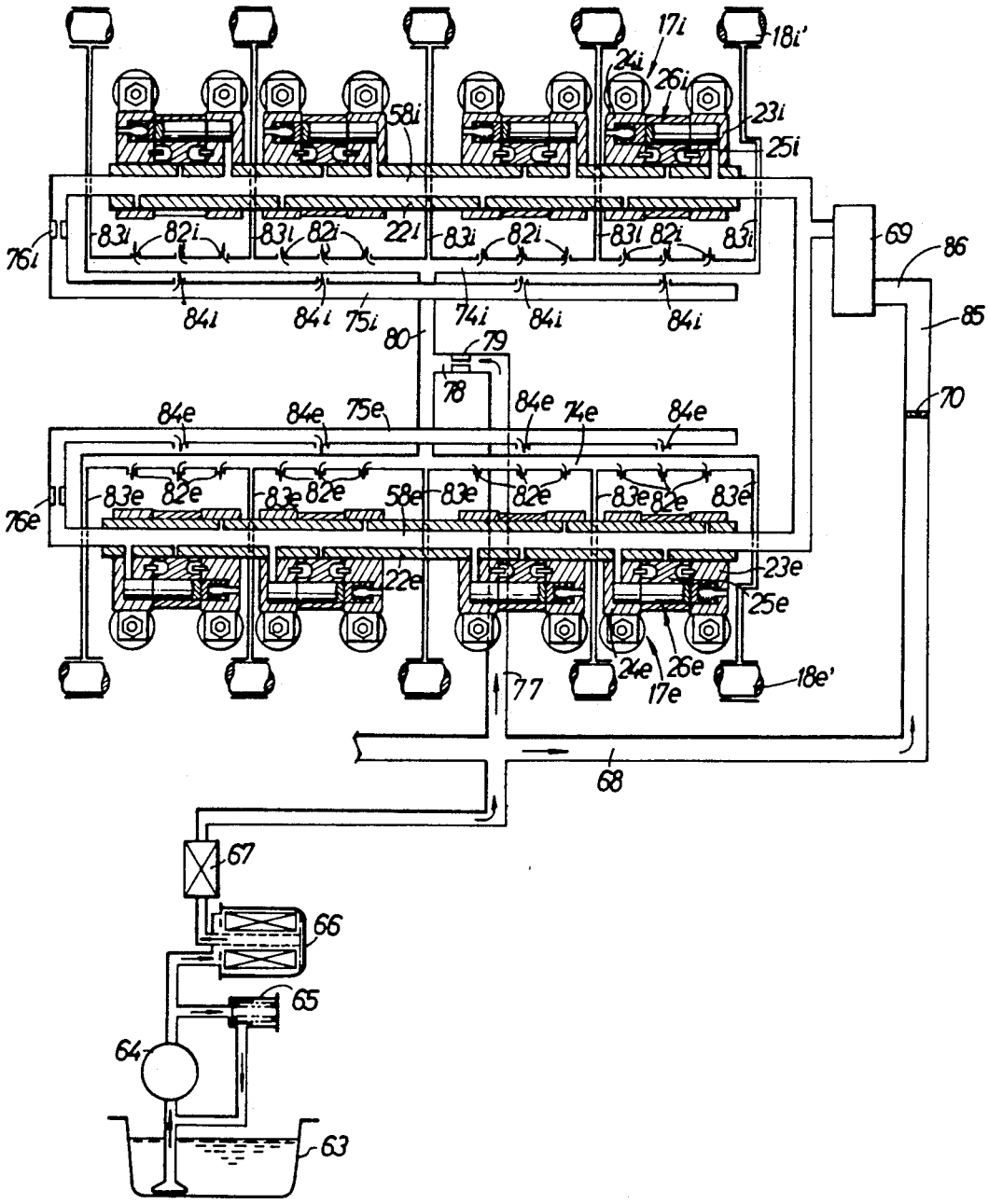

A system for supplying an oil to the valve-operating devices 11*i* and 11*e* will be described with reference to FIG. 7. An oil gallery 68 is connected through a relief valve 65, an oil filter 66 and an oil cooler 67 to a discharge port in an oil pump 64 as an oil pressure supply source for pumping a working oil from an oil pan 63, so that an oil pressure is supplied from the oil gallery 68 to the valve operation mode changing mechanisms 26*i* and 26*e*, while a lubricating oil is supplied from the oil gallery 68 to individual portions to be lubricated in the valve-operating devices 17*i* and 17*e*.

A selector valve 69 is connected to the oil gallery 68 for changing the oil pressure supplied to the respective oil feed passages 58*i* and 58*e* in the rocker shafts 22*i* and 22*d*. A filter 70 is provided in the oil gallery 68 upstream of the selector valve 69. Passage defining members 12*i* and are fastened on upper surfaces of the cam holders 29 and 30 by a plurality of bolts 73 to extend the length of and parallel to the cam shafts 18*i* and 18*e*, respectively. The passage defining members 72*i* and 72*e* are provided with lower-speed lubricant passages 74*i* and 74*e* closed at their opposite ends and with higher-speed lubricant passages 75*i* and 75*e* communicating with the oil feed passages 58*i* and 58*e* through restrictions 76*i* and 76*e*, respectively.

An oil passage 77 is provided to extend upwardly within the cylinder block 1, as shown in FIG. 5, from the oil gallery 68 upstream of the filter 70 and has a restriction 79 at the middle. The oil passage 77 is provided in the cylinder block 1 at its substantially central portion in the direction of arrangement of the cylinders 2. A lower-speed hydraulic pressure supply passage 78 is provided in the cam support portion 28 substantially central in the direction of arrangement of the cylinders 2 to communicate with the oil passage 77. The supply passage 78 is comprised of a passage portion 78*a* formed as an annular portion surrounding the bolt 33 and communicating with the upper end of the oil passage 77, a passage portion 78*b* communicating with an upper end of the passage portion 78*a* and extending toward a central portion between the valve-operating devices 17*i* and 17*e*, and a passage portion 78*c* extending upwardly from communication with the passage portion 78*b* to the upper surface of the cam support portion 28.

The cam holder 30 at a location substantially central in the direction of arrangement of the cylinders 2 is provided with a generally Y-shaped oil passage 80 having its lower end connected to an upper end of the passage portion 78*c* of the lower-speed hydraulic pressure supply passage 78 and bifurcated toward both of the valve-operating devices 17*i* and 17*e*. Upper ends of the bifurcated oil passage 80 are connected in communication with the lower-speed lubricant passages 74*i* and 74*e*, respectively. Specifically, the passage defining members 72*i* and 72*e* are provided with communication holes 81*i* and 81*e* which permit the communication of the bifurcated oil passage 80 with the lower-speed lubricant passages 74*i* and 74*e*, respectively.

The lower-speed lubricant passages 74*i* and 74*e* serve to supply lubricating oil to slide-contact portions between the cams 19*i*, 19*e*, 20*i*, 20*e*, 21*i*, 21*e* and the rocker arms 23*i*, 23*e*, 24*i*, 24*e*, 25*i*, 25*e* as well as to cam journal portions 18*i*' and 18*e*' of the cam shafts 18*i* and 18*e*. Therefore, at places corresponding to the lower-speed cams 19*i*, 19*e*, 20*i* and 20*e* and the higher-speed cams 21*i* and 21*e*, the lower surfaces of the passage defining member 72*i* and 72*e* are provided with lubricating-oil ejecting holes 82*i* and 82*e* communicating with the lower-speed lubricant passages 74*i* and 74*e*, and also with lubricating-oil supply passages 83*i* and 83*e* communicating with the lower-speed lubricant passages 74*i* and 74*e* to supply the lubricating oil to the cam journal portions 18*i*' and 18*e*' of the cam shafts 18*i* and 18*e*, respectively.

The higher-speed lubricant passages 75*i* and 75*e* serve to supply the lubricating oil to the slide-contact portions between the higher-speed cams 21*i* and 21*e* and the free rocker arms 25*i* and 25*e* and therefore, at places corresponding to the higher-speed cams 21*i* and 21*e*, the lower surfaces of the passage defining members 72*i* and 72*e* are provided with lubricant ejecting holes 84*i* and 84*e* communicating with the higher-speed lubricant passages 75*i* and 75*e*, respectively.

It is to be noted that the passage defining members 72*i* and 72*e* are disposed above the cam shafts 18*i* and 18*e*, so that the lubricating oil ejected through the lubricating-oil ejecting holes 84*i* and 84*e* is partially scattered sideways in response to the rotation of the cam shafts 18*i* and 18*e*. Moreover, the cam shafts 18*i* and 18*e* are rotated in the same direction and hence, the lubricating oil ejected through one of the lubricating-oil ejecting holes 84*i* is partially scattered toward the exhaust valve operating device lie, while the lubricating oil ejected through the other lubricating-oil ejecting hole 84*e* is partially scattered toward the side opposite from the intake value operating device 17*i*. Because the central blocks 36 and 49 are located between the valve-operating devices 17*i* and 17*e* at places corresponding to the lubricating-oil ejecting holes 84*i* and 84*e*, a portion of the lubricating oil ejected through the lubricating-oil ejecting hole 84*i* and scattered is reflected by the central blocks 36 and 49 back toward the slide-contact portion between the higher-speed cam 21*i* and the free rocker arm 25*i*. On the other hand, a portion of the lubricating oil ejected through the lubricating-oil ejecting hole 84*e* and scattered impinges upon the side of the cylinder head 3 and is reflected therefrom back toward the slide-contact portion between the higher-speed cam 21*e* and the free rocker arm 25*e*. The distances between the slide-contact portion between the higher-speed cam 21*i* and the free rocker arm 25*i* and the central blocks 36 and 49 are smaller than the distance between the slide-contact portion between the higher-speed cam 21*e* and the free rocker arm 25*e* and the side of the cylinder head 3 and therefore, the amount of lubricating oil reflected from the central blocks 36 and 49 back to the slide-contact portion of the higher-speed cam 21*i* with the free rocker arm 25*i* is larger than that of lubricating oil reflected from the side of the cylinder head 3 back to the slide-contact portion of the higher-speed cam 21*e* with the free rocker arm 25*e*. For this reason, the diameter of the lubricating-oil ejecting hole 84*i* is set at a smaller value than that of the lubricating-oil ejecting hole 84*e*, so that the amount of lubricating oil ejected through the lubricating-oil ejecting hole 84*i* is smaller than that of lubricating oil ejected through the lubricating-oil ejecting hole 84*e*. In addition, the restricting or throttling degree of the restriction 76*i* provided between the oil feed passage 58*i* and the higher-speed lubricant passage 75*i* is set smaller than that of the restriction 76*e* provided between the oil feed passage 58*e* and the higher-speed lubricant passage 75*e*, so that the amount of lubricating oil supplied to the higher-speed lubricant passage 75*i* is smaller than that lubricating oil supplied to the higher-speed lubricant passage 75*e*.

It should be noted that the lubricating-oil ejecting holes 82*i* and 82*e* communicating with the lower-speed lubricatant passages 74*i* and 74*e* are of substantially the same diameter because the distances are substantially identical between the members which reflect the lubricating oil in the directions in which the lubricating oil is scattered by the rotation of the cam shafts 18*i* and 18*e* and the slide-contact portions between the lower-speed cams 19*i*, 19*e*, 20*i*, 20*e* and the first and second drive rocker arms 23*i*, 23*e*, 24*i*, 24*e*.

Figure 8:
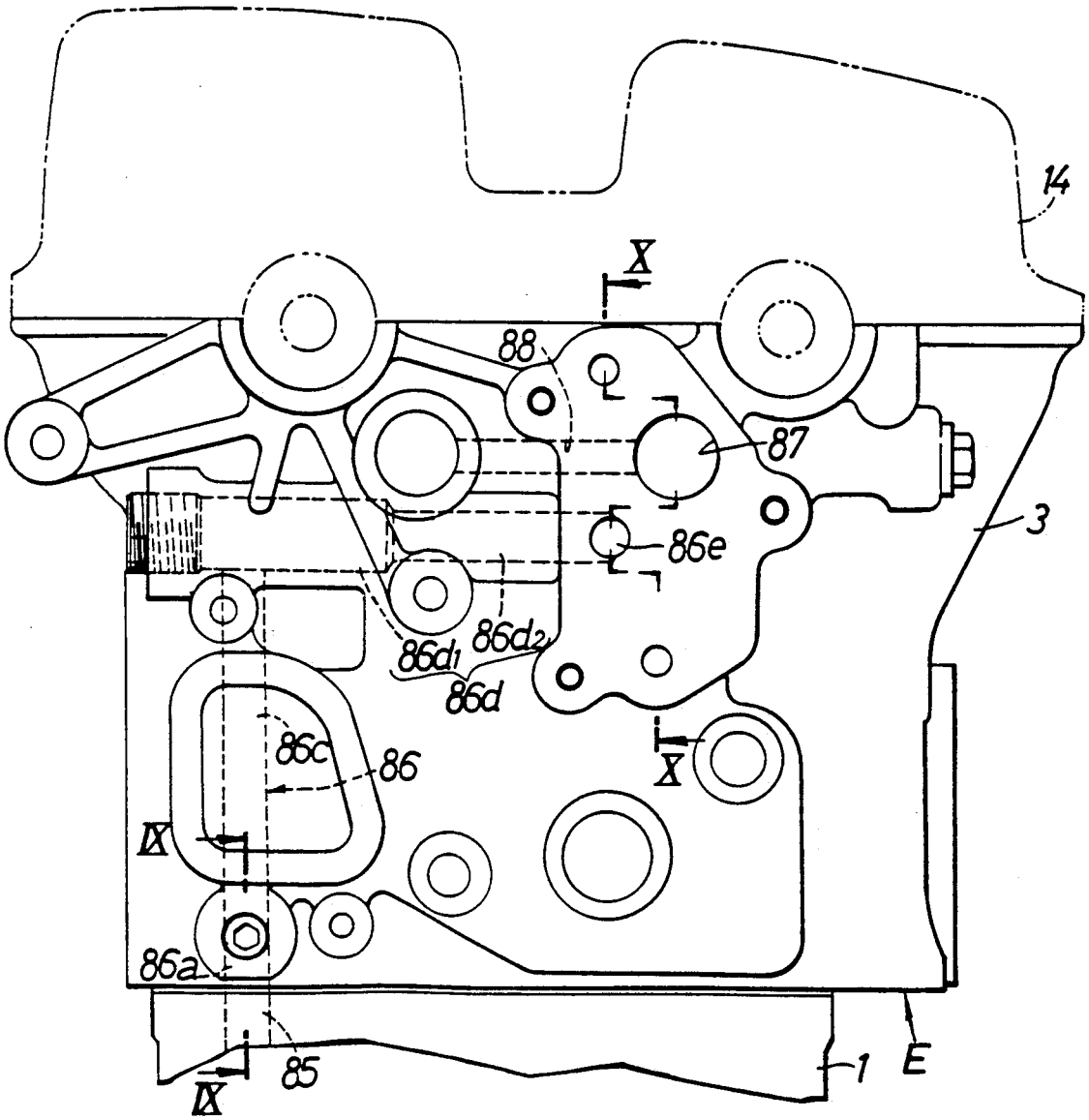
Figure 9:
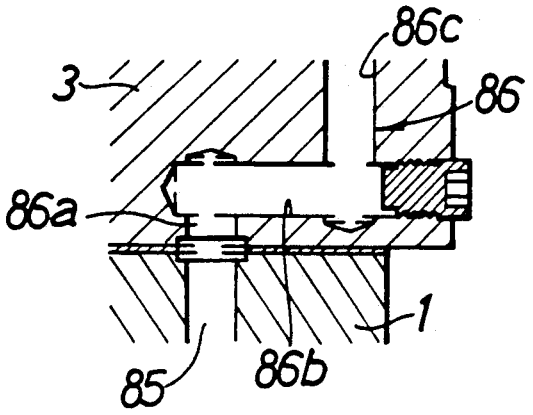

Referring to FIGS. 8 and 9, an oil passage 85 is provided in the cylinder block 1 independently from the aforesaid oil passage 77 to extend vertically at a place near one end in the direction of arrangement of the cylinders 2. This oil passage 85 communicates with the oil gallery 68 through the filter 70 (see FIG. 7). A higher-speed hydraulic pressure supply passage 86 is provided in the cylinder head 3 at a place near to one end in the direction of arrangement of the cylinders 2 to communicate with the oil passage 85. The supply passage 86 is comprised of a passage portion 86*a* extending slightly upwardly in communication with the upper end of the oil passage 85, a passage portion 86*b* extending horizontally toward that one end of the cylinder head 3 in communication with an upper end of the passage portion 86*a*, a passage portion 86*c* extending upwardly in communication with the passage portion 86*b*, a passage portion 86*d* communicating with an upper end of the passage portion 86*c* and extending horizontally toward the rocker shaft 22*e* of the exhaust valve operating device 17*e*, and a passage portion 86*e* communicating with the passage portion 86*d* and opening into one end face of the cylinder head 3.

Figure 10:
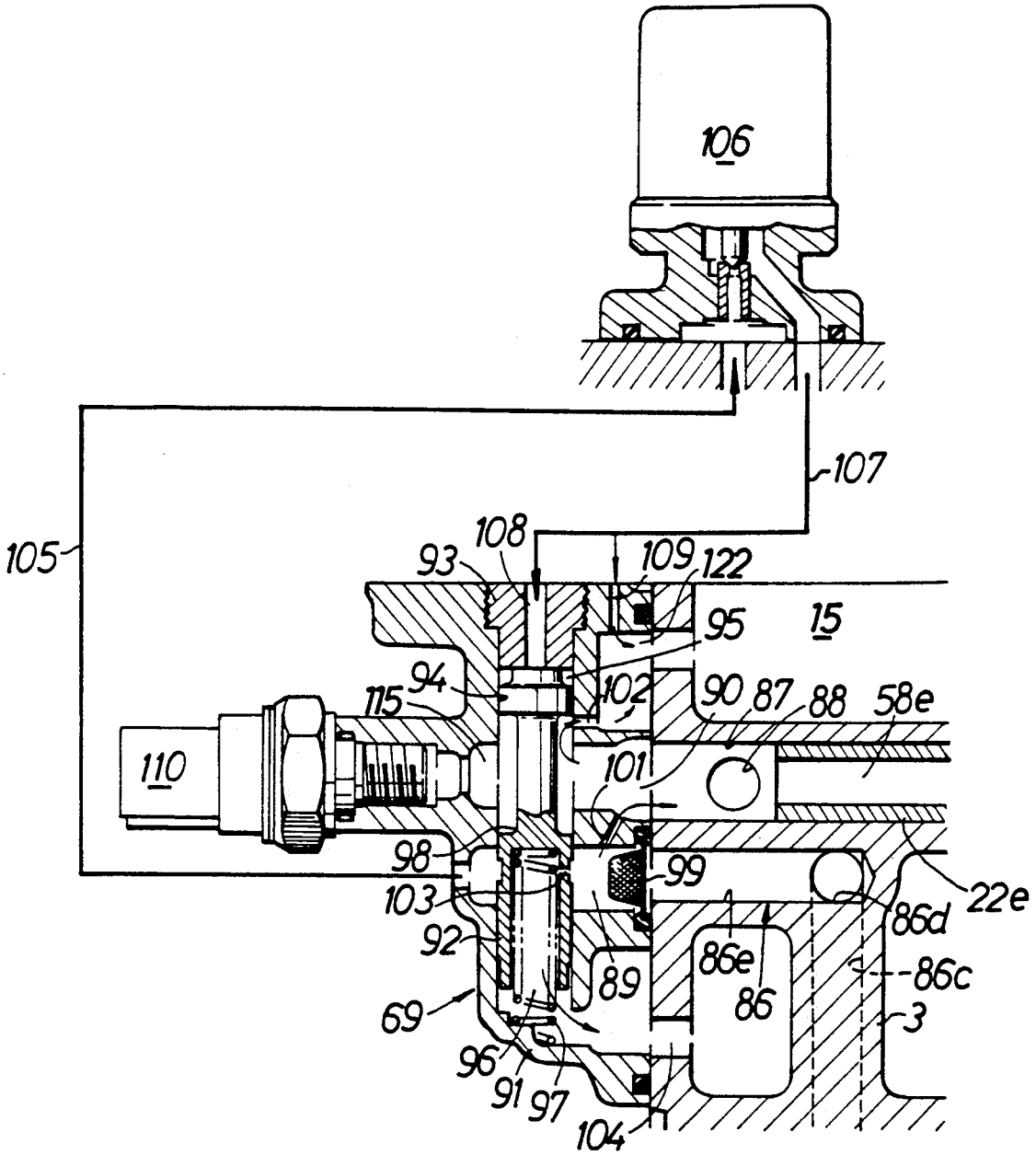

Referring also to FIG. 10, at an end portion supporting one end of one of the rocker shafts 22*i* and 22*e*, namely, the exhaust side rocker shaft 22*e*, the cylinder head 3 is provided with an oil feed port 87 leading to the oil feed passage 58*e* within the rocker shaft 22*e* from the end face of the cylinder head 3. Also, the cylinder head 3 is provided with a communication passage 88 which permits the communication of the oil feed port 87 with the oil feed passage 58*i* within the intake side rocker shaft 22*i*.

The selector valve 69 is attached to the opening of the higher-speed hydraulic pressure supply passage 86 on the end face of the cylinder head 3, i.e., the passage portion 86*e*, and is comprised of valve spool 92 slidably received in a housing 91 which is attached to that end face of the cylinder head 3 and has an inlet port 89 leading to the passage portion 86*e* and an outlet port 90 leading to the oil feed port 87.

The housing 91 is provided with a vertically extending cylinder bore 94 closed at its upper end by a cap 93 and the valve spool 92 is slidably received in the cylinder bore 94 to define a working oil chamber 95 with the cap 93. If the axis of the cylinder bore 94 is vertical in this manner, the weight of the valve spool 92 is not applied to the slide surface of the cylinder bore 94, so that the valve spool 92 may be operated smoothly.

A spring 97 is contained in a spring chamber 96 defined between a lower portion of the housing 91 and the valve spool 92 for biasing the valve spool 92 upwardly, i.e., in a closing direction. The valve spool 92 is provided with an annular recess 98 which is capable of putting the inlet port 89 and the outlet port 90 into communication with each other and, as shown in FIG. 10, when the valve spool 92 is in the upper position, the inlet port 89 and the outlet port 90 are out of communication with each other.

With the housing 91 attached to the end face of the cylinder head 3, an oil filter 99 is clamped between the inlet port 89 and the passage portion 86*e* of the higher-speed hydraulic pressure supply passage 86. The housing 91 has an orifice 101 therein that permits restricted communication between the inlet port 89 and the outlet port 90. Thus, even if the valve spool 92 is in a closed position, the inlet port 89 and the outlet port 90 are in communication with each other through the orifice 101, so that a hydraulic pressure, restricted or throttled by the orifice 101, may be supplied from the outlet port 90 into the oil feed port 87.

The valve spool 92 is also provided with an orifice 103 which permits communication of the inlet port 89 with the spring chamber 96 irrespective of the position of the valve spool 92. The housing 91 has an opening in the side face aligned with a through hole 104 in the cylinder head 3 to permit the spring chamber 96 to communicate with the interior of the cylinder head 3, so that oil passed through the orifice 103 into the spring chamber 96 is returned via the through hole 104 into the cylinder head 3. This allows dirt or the like deposited on the spring 97 to be flushed off by such oil, thereby avoiding any adverse effects by such dirt or the like on the expansion and contraction of the spring 97.

A line 105 is connected to the housing 91 to normally communicate with the inlet port 89 and is also connected to a line 107 through a solenoid valve 106. In turn, the line 107 is connected to a connecting hole 108 in the cap 93. Thus, when the solenoid valve 106 is open, hydraulic oil is supplied to the working oil chamber 95, so that the valve spool 92 is driven in an opening direction by the hydraulic pressure of the oil introduced into the working oil chamber 95.

The working chamber 15 is provided in an upper portion in the cylinder head 3 and also functions as a drain chamber which permits the working oil to escape. For the purpose of providing a reduction in weight, the surface of housing 91 attached to the outer surface of the cylinder head 3 is provided with a wall-cutaway portion defining an open chamber 122 which leads to the working chamber 15. Moreover, a leak jet 109 is provided in the housing 91 and opens at its inner end into the open chamber 122 to communicate the line 107 from the inside of the working oil chamber 95 to the open chamber 122. The leak jet 109 serves to allow the escape of the hydraulic pressure remaining in the working oil chamber 95 when the solenoid valve 106 has been closed.

Further, the housing 91 is provided with a bypass port 102 which leads to the outlet port 90 through the annular recess 98 only when the valve spool 92 is in its closed position. The bypass port 102 opens into the open chamber 122.

An oil reservoir 115 is provided in the housing 91 on a side of the valve spool 92 opposite from the outlet port 90 to face an inner surface of the cylinder bore 94 and to communicate with the outlet port 90. A pressure detector 110 for detecting the hydraulic pressure in the outlet port 90, i.e., in the oil feed passages **58*i* and 58*e* is attached to the housing 91 and communicates with the oil reservoir 115. The pressure detector 110 serves to detect whether the selector valve 69** is operating normally or not.

It should be noted that if the solenoid valve 106 is opened to move the valve spool 92 of the selector valve 69 from a lower hydraulic pressure supply position, i.e., the closed position, to a higher hydraulic pressure supply position, i.e., the open position, the working oil within the higher-speed hydraulic pressure supply passage 86 flows into the oil feed passages **58*i* and 58*e* quickly. Therefore, there is a potential problem of a temporary reduction in hydraulic pressure occurring in the higher hydraulic pressure supply passage 86 just in front of the selector valve 69. In order to avoid such a temporary reduction in hydraulic pressure, a passage portion having a sufficient volume is provided in a location just in front of the selector valve 69, i.e., at the substantially horizontal passage portion 86*d* at the middle of the higher hydraulic pressure supply passage 86, so that an accumulator chamber effect may be exhibited in such portion. More specifically, referring again to FIG. 8, the passage portion 86*d* is substantially horizontal in the cylinder head 3 and is comprised of an enlarged or larger diameter portion $86d_1$ leading to the vertically extending passage portion 86*c*, and a smaller diameter portion $86d_2$ connected to the enlarged portion $86d_1$ through a stepped portion. The enlarged portion $86d_1$ is formed to have a substantial volume. The cross section of the smaller diameter portion $86d_2$ is set larger than that of the passage portion 86*c***.

Figure 11:
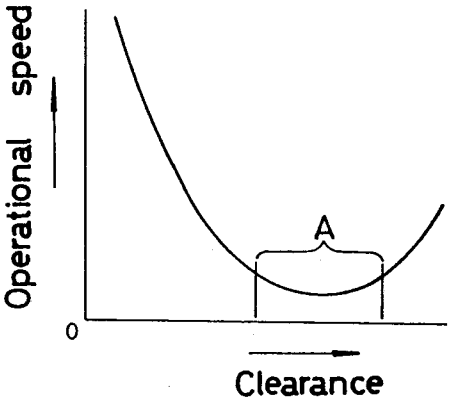

It is to be understood that the clearance between the bore 94 in housing 91 and the valve spool 92 in the selector valve 69 influences the working characteristics. Specifically, as shown in FIG. 11, when the clearance is too small, the frictional resistance between the housing 91 and the valve spool 92 is large, so that the speed of operation is relatively large. On the other hand, when the clearance is too large, the working oil leaks through the clearance, so that the hydraulic pressure acting on one end of the valve spool 92 is reduced, leading to a decreased speed of operation. Accordingly, it is desirable to keep the clearance in a range shown as A in FIG. 11.

Figure 12:
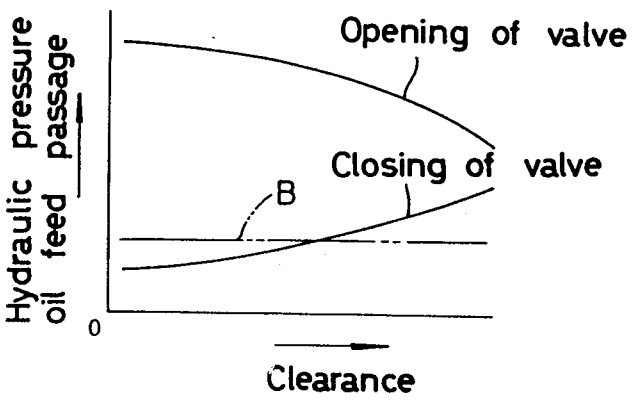

The influence of the clearance on the hydraulic pressure downstream of the selector valve 69, i.e. in the oil feed passages **58*i* and 58*e* is shown in FIG. 12 for a condition of a constant supplied hydraulic pressure. If the clearance exceeds a certain size, the hydraulic pressure is larger than a lowest changing pressure B of the operation mode changing mechanism 26*i*, 26*e*** in spite of a valve-closed condition.

Figure 13:
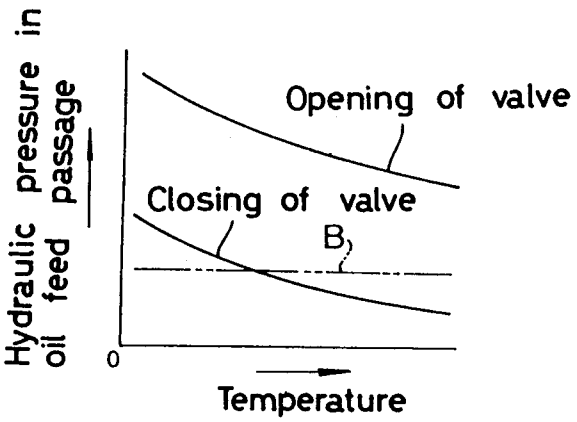

In addition, the influence on the hydraulic pressure in the oil feed passages **58*i* and 58*e* resulting from a variation in temperature, i.e., a variation in viscosity of the working oil is as shown in FIG. 13** for a clearance of a given size, wherein as the temperature increases, the hydraulic pressure decreases.

Figure 14:
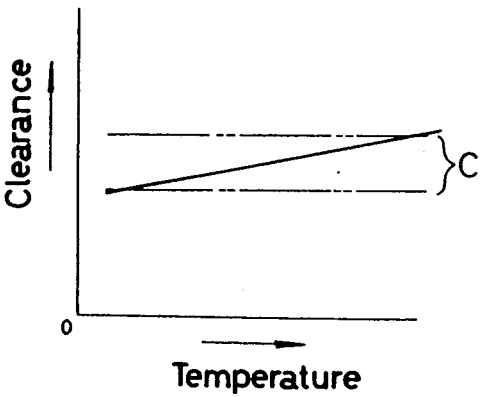

Thus, in view of the characteristics shown in FIGS. 11 to 13, it is necessary to increase the clearance as the temperature increases as shown in FIG. 14 in order to improve the speed of operation at an increased temperature while avoiding any misoperation at a lower temperature. That is, it is necessary to make the housing 91 from a material having a coefficient of thermal expansion larger than that of the material for the valve spool 92. From this viewpoint, the housing 91 may be formed of, for example, an aluminum die cast having a linear thermal expansion coefficient of $23.1\times10^{-6}/°$ C., while the valve spool 92 may be formed of, for example, a chromium-molybdenum steel having a linear thermal expansion coefficient of $10.7\times10^{-6}$. Moreover, the initial clearance between the housing 91 and the valve spool 92 is set so that the clearance varies within the range C shown by the two-dot broken lines in FIG. 14 despite the variation in temperature, without departing from ranges of the characteristics shown in FIGS. 11 to 13.

Figure 15:
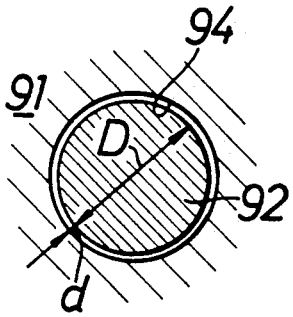

The acceptable clearance varies even depending upon the outside diameter of the valve spool 92, and may be set such that the clearance or distance, represented by "d" in FIG. 15, between the inner surface of the cylinder bore 94 and the outside diameter of the valve spool 92, represented by D, may be related in the following manner: $d/D=0.75$ to $7\times10^{-3}$.

Figure 16:
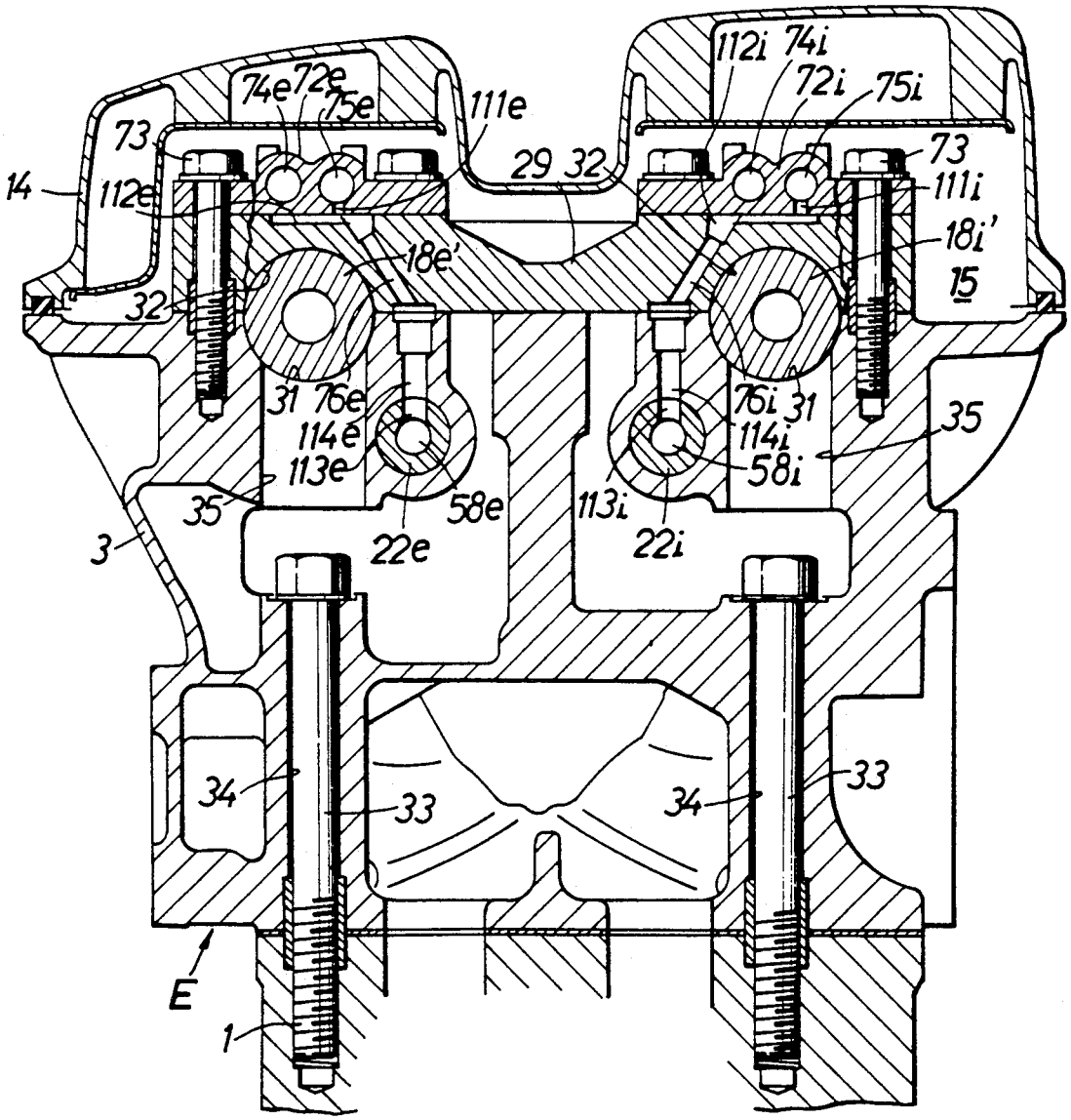

Referring to FIG. 16, at the other end of the cylinder head 3, i.e., at the end opposite from the end to which the selector valve 69 is attached, communication holes 111*i* and 111*e* open downwardly in the ends of the passage defining members 72*i* and 72*e* to lead to the higher-speed lubricant passages 75*i* and 752, respectively, and a pair of grooves are provided in the upper surface of the cam holder 29 to define passages 112*i* and 112*e* leading to the communication holes 111*i* and 111*e* between the passage defining members 72*i* and 72*e*. Additionally, communication holes 113*i* and 113*e* are provided in the ends of the rocker shafts 22*i* and 22*e* to lead to the oil feed passages 58*i* and 58*e*, and passages 114*i* and 114*e* made in the cylinder head 3 in communication with these communication holes 113*i* and 113*e* communicate with the passages 112*i* and 112*e* through restrictions 76*i* and 76*e* made in the cam holder 29. Thus, the oil supplied to the oil feed passages 58*i* and 58*e* is supplied to the higher-speed lubricant passages 75*i* and 75*e* through the restrictions 76*i* and 76*e*.

The operation of this embodiment now will be described. The lubricating oil is supplied to the lower-speed lubricant passages 74*i* and 74*e* through the oil passage 77, the orifice 79, the lower-speed hydraulic pressure supply passage 78 and the bifurcated oil passage 80, all independent from the valve operation mode changing mechanisms 26*i* and 26*e*, and hence, even if the hydraulic pressure is controlled by the selector valve 69 to operate the valve operation mode changing mechanisms 26*i* and 26*e*, a normally constant hydraulic pressure can be supplied regardless of this operation. Thus, the lubricating oil is supplied at a stabilized pressure to the slide-contact portions between the lower-speed cams 19*i*, 19*e*, 20*i* and 20*e* and the drive rocker arms 23*i*, 23*e*, 24*i* and 24*e*, and the slide-contact portions between the higher-speed cams 21*i* and 21*e* and the free rocker arms 25*i* and 25*e* as well as the cam journal portions 18*i*' and 18*e*' of the cam shafts 18*i* and 18*e*.

Moreover, since the oil passage 77, the lower-speed hydraulic pressure supply passage 78 and the bifurcated oil passage 80 are disposed substantially centrally in the direction of arrangement of the cylinders 2, the amount of lubricating oil is substantially equalized with a substantially uniform loss of flowing pressure of the lubricating oil to the lubricant oil ejecting holes 82*i* and 82*e* and the lubricant oil supply passages 83*i* and 83*e*.

Figure 17:
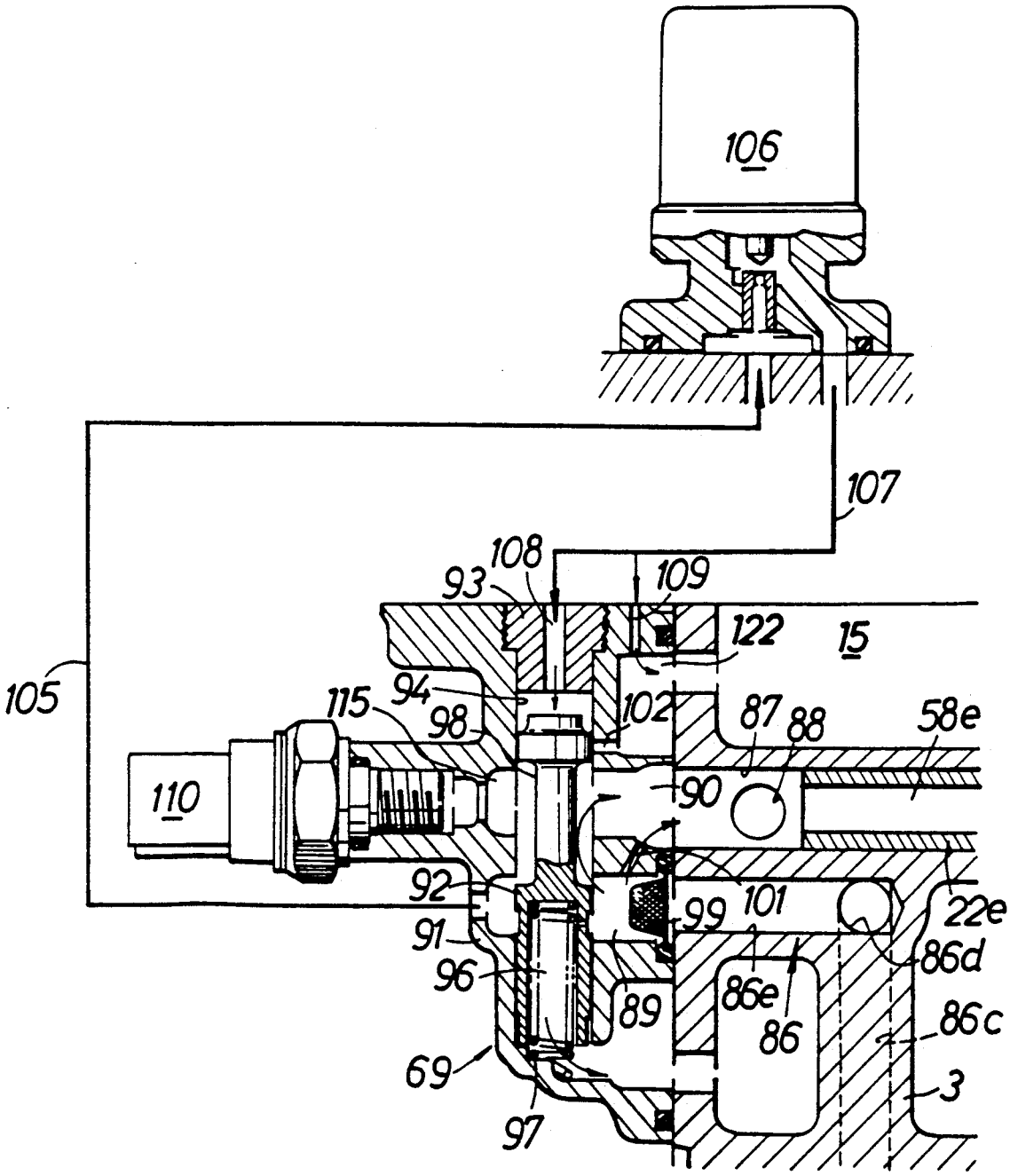

To provide the changing operation of the operation mode changing mechanisms 26*i* and 26*e* to bring the intake valves 10*i* and the exhaust valves 10*e* into a higher-speed operation mode, the selector valve 69 is opened as shown in FIG. 17. More specifically, the solenoid valve 106 is opened to supply the hydraulic pressure to the working oil chamber 95, thereby causing the valve spool 92 to be opened, so that the hydraulic pressure is supplied to the oil feed passages 58*i* and 58*e* and to each of the hydraulic pressure chambers 56 in the valve operation made changing mechanisms 26*i* and 26*e*. This causes the valve-operation mode changing mechanisms 26*i* and 26*e* to be operated for connecting each free rocker arms 25 to the adjacent rocker arms 23 and 24 so that the intake valves 10*i* and exhaust valves 10*e* are operated to be opened or closed in the higher-speed operation mode.

In this case, a relatively large amount of the working oil is supplied quickly from the higher-speed hydraulic pressure supply passage 86 to the oil feed passages 58*i* and 58*e*, but because the enlarged or larger diameter portion $86d_1$ provided in the middle of the passage portion 86*d* has a sufficient volume and the cross-sectional area of the smaller diameter portion $86d_2$ is set larger than that of the passage portion 86*c*, the hydraulic pressure can be smoothly supplied while preventing a pulsation from being produced in the hydraulic pressure supplied to the oil feed passages 58*i* and 58*e*. In addition, during flowing of the working oil from the passage portion 86*c* to the larger diameter portion $86d_1$, there is a possibility of the working oil being expanded to produce air bubbles, but because the stepped portion is formed at the connection between the larger diameter portion $86d_1$ and the smaller diameter portion $86d_2$, it is possible to avoid, to the utmost, any air flowing to the selector valve 69 and any malfunction of the selector valve 69 as a result of the presence of air.

In the higher-speed operation mode, the lubricant oil supplied to the higher-speed lubricant passages 75*i* and 75*e* is ejected through the lubricant oil ejecting holes 84*i* and 84*e*, and this makes it possible to provide a sufficient lubrication of, particularly, the slide-contact portions even with an increased surface pressure between the higher-speed cams 21*i* and 21*e* and the free rocker arms 15*i* and 15*e*. Moreover, because the size of the lubricant oil ejecting holes 84*i* and 84*e* and the restricting degree of the restrictions 76*i* and 76*e* are both set to depend upon the distance between the member reflecting the lubricant oil scattered in response to the rotation of the cam shafts 18*i* and 18*e* and the slide-contact portions between the higher-speed cams 21*i* and 21*e* and the free rocker arms 25*i* and 25*e*, it is possible to substantially equalize the amount of lubricant oil supplied to the above-described slide-contact portions.

When the selector valve 69 has been operated for a change-over from the lower-speed operation mode to the higher-speed operation mode, there is somewhat of a time lag until the hydraulic pressure in the higher-speed lubricant passages 75*i* and 75*e* is increased to the maximum through the restrictions 76*i* and 76*e*, and somewhat of a time delay until the lubricating oil ejects through the lubricant oil ejecting holes 84*i* and 84*e*. However, because the lubricant oil ejecting holes 82*i* and 82*e* in the lower-speed lubricant passages 74*i* and 74*e* are disposed also at places corresponding to the slide-contact portions of the higher-speed cams 21*i* and 21*e* with the free rocker arms 25*i* and 25*e*, the slide-contact portions of the higher-speed cams 21*i* and 21*e* with the free rocker arms 25*i* and 25*e* will not be lacking in lubricant oil even if there is a somewhat time delay as described above because lubricant oil is continuously supplied through ejecting holes 82*i* and 82*e*. In addition, when the selector valve 69 is closed with the individual pins 51, 52 and 53 of the valve operation mode changing mechanisms 26*i* and 26*e* remaining locked temporarily, during changing to a condition of the lower-speed operation mode, the surface pressure of the slide-contact portions of the higher-speed cams 21*i* and 21*e* with the free rocker arms 25*i* and 25*e* is larger as in the higher-speed operation mode, but even during this time, the lubricant oil is ejected through the lubricant oil ejecting holes 82*i* and 82*e* leading to the lower-speed lubricant passages 74*i* and 74*e* to the slide-contact portions of the higher-speed cams 21*i* and 21*e* with the free rocker arms 25*i* and 25*e*, so that a sufficient lubrication can be achieved.

When the opening and closing mode of the intake valves 10*i* and the exhaust valves 10*e* is to be changed from the higher-speed operation mode to the lower-speed operation mode, the solenoid valve 106 is closed. During such closing of the solenoid valve 106, the hydraulic pressure in the line 107 escapes through the leak jet 109, so that the hydraulic pressure in the working oil chamber 95 is quickly released and in response to this, the selector valve 69 is closed quickly. Further, when the selector valve 69 becomes closed, the hydraulic pressure in the oil feed passages 58*i* and 58*e* escapes through the bypass port 102 into the cylinder head 3, so that the hydraulic pressure in the oil feed passages 58*i* and 58*e* and in the hydraulic chambers 56 in the valve operation changing mechanisms 26*i* and 26*e* becomes lower quickly, thereby leading to an improvement in the speed of response of the change-over from the higher-speed operation mode to the lower-speed operation mode.

Furthermore, the pressure detector 110 for detecting whether the selector valve 69 operates normally or not, i.e., whether the hydraulic pressure in the oil feed passages 58*i* and 58*e* is the expected high or low pressure, is not easily influenced by the dynamic pressure due to flowing of the working oil whereby the pressure detector 110 can correctly detect only the hydrostatic pressure, because it communicates with the oil reservoir 115 which is located on the opposite side of the valve spool 92 from the oil supply port 87 in a flow-path reverse portion at which the working oil is reversed to flow from the passage portion 86*e* of the higher-speed hydraulic pressure supply passage 86 toward the oil supply port 87.

Since the housing 91 of the selector valve 69 is formed of a material having a thermal expansion coefficient larger than that of the valve spool 92, the clearance between the housing 91 and the valve spool 92 is relatively large at an increased temperature, thereby permitting the speed of operation to be improved with a reduced frictional resistance between the housing and the valve spool 92. On the other hand, at a lower temperature the clearance is reduced and hence the leakage of the working oil through the clearance can be suppressed whereby an excess of working oil can be prevented from being supplied to the oil feed passages 58*i* and 58*e* irrespective of the valve-closed condition and thereby preventing any misoperation.

Figure 18:
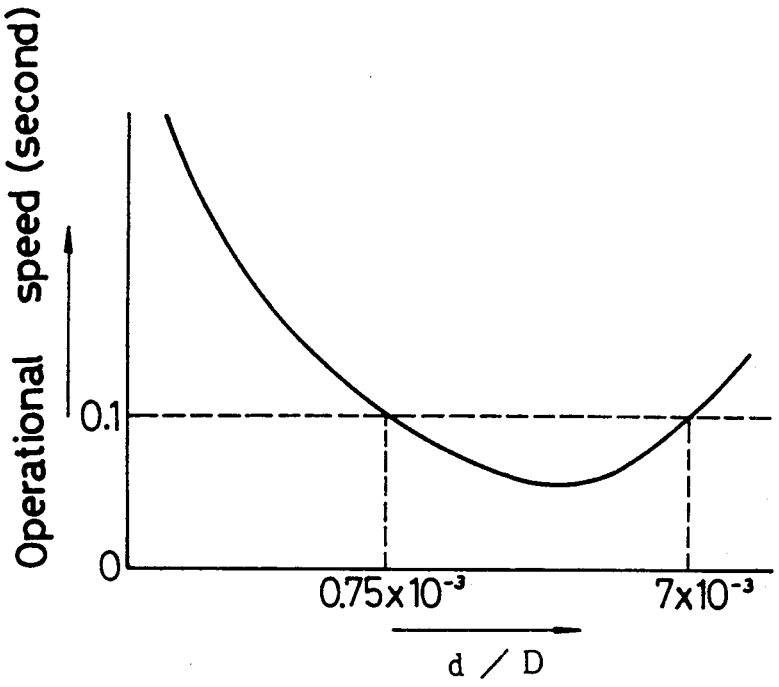

If the ratio d/D of the clearance distance between the inner surface of the cylinder bore 94 and the outer surface of the valve spool 92 in the selector valve 69 relative to the outside diameter of the valve spool 92 is indicated by valves on the abscissa of a graph, and the speed of operation of the selector valve 69 is indicated by values on the ordinate, the relationship between the ratio d/D and the speed of operation of the selector valve 69 is as shown in FIG. 18. As apparent from FIG. 18, when the ratio d/D is smaller, the speed of operation is relatively large because the frictional resistance between the housing 91 and the valve spool 92 is larger. On the other hand, when the ratio d/D increases, the working oil leaks through the clearance between the inner surface of the cylinder bore 94 and the outer surface of the valve spool 92, so that the hydraulic pressure acting on one end of the valve spool 92 is reduced, leading to an increased speed of operation. It is necessary for the speed of operation of the selector valve 69 to be a maximum of 0.1 second. The experiments made by the present inventors showed that when the maximum speed of operation was of 0.1 second or less, the d/D was in a range of 0.75 to $7\times10^{-3}$.

Accordingly, by setting the ratio d/D in a range of 0.75 to $7\times10^{-3}$ it is possible to maintain the speed of operation of the selector valve 69 at a high level of less than 0.1 second, and correspondingly to provide a quick hydraulic changing operation of the valve operation changing mechanisms 26*i* and 26*e* to contribute to an improvement in response characteristic.

In addition, because only one lower-speed hydraulic pressure supply passage 78 and only one higher-speed hydraulic pressure supply passage 86 is required, the machining of the cylinder head 3 is extremely facilitated. Further, since the selector valve 69 is attached to one end face of the cylinder head 3, the structure of attachment is simplified. Still further, the oil feed passages 58*i* and 58*e* are used for supplying oil both to the valve operation mode changing mechanisms 26*i* and 26*e* and to the higher-speed lubricant passages 75*i* and 75*e*, it is unnecessary to provide an additional oil supply lines in the cylinder head 3, and this makes it possible to provide an efficient supply of the oil while avoiding increases in the number of parts and in the number of machining steps.

Figure 19:
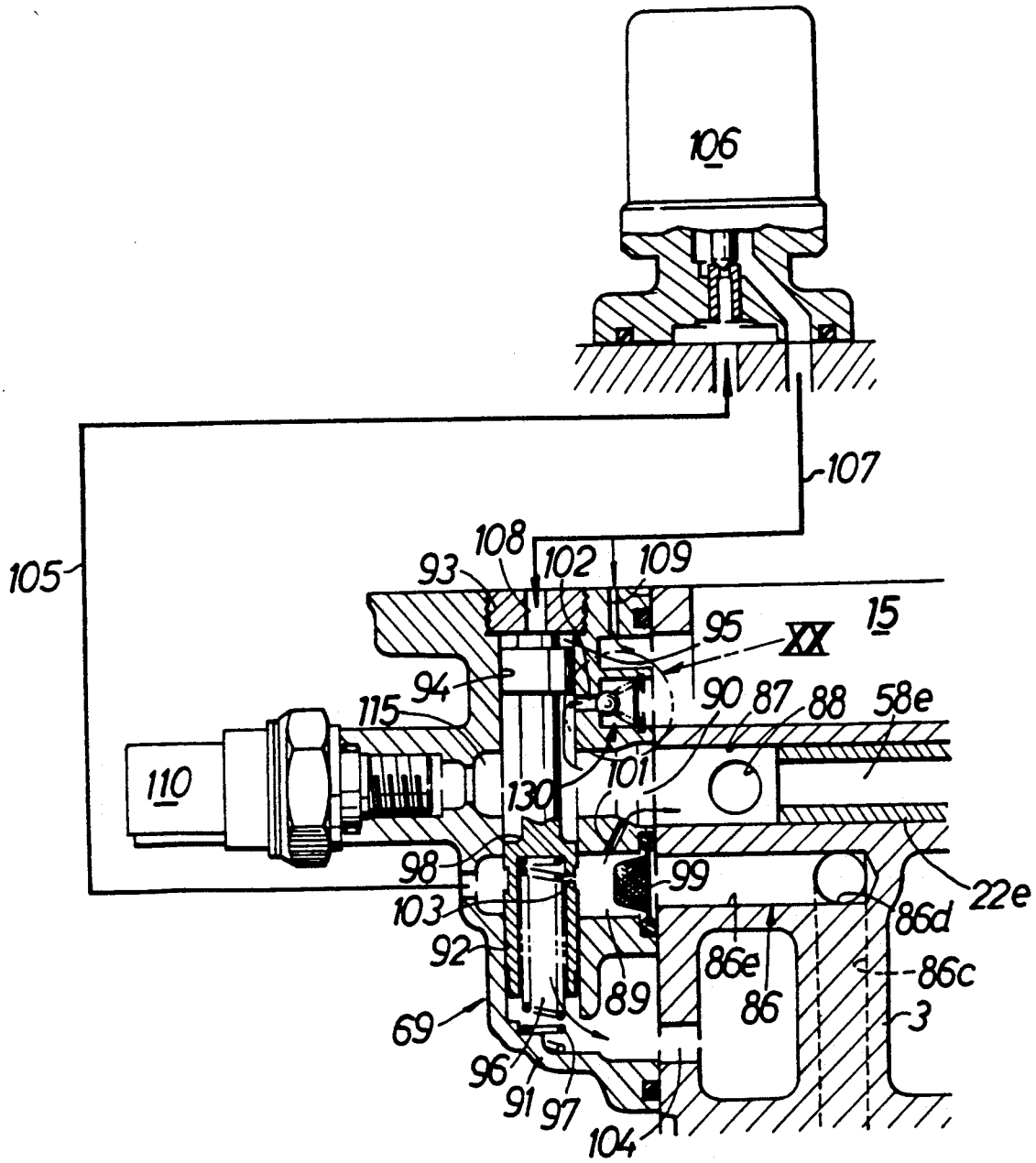
Figure 20:
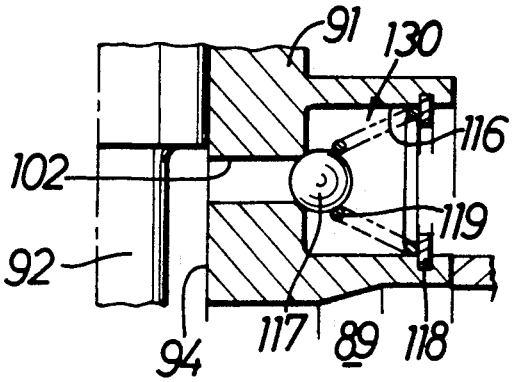

FIGS. 19 and 20 illustrate another embodiment of the present invention, wherein portions corresponding to like portions in the previously described embodiment are designated by the same reference characters and will not be described in detail again.

Relief valve 130 is disposed in the housing 91 of the selector valve 69 and is adapted to be opened when the hydraulic pressure in the bypass port 102 is larger than a given value. More specifically, the housing 91 has a valve chamber 116 provided between the bypass port 102 and an outer surface of the housing 91 communicating with the working chamber 15 at an upper portion within the cylinder head 3. The relief valve 130 is comprised of a relief valve sphere 117 contained in the valve chamber 116 for closing the outer end of the bypass port 102 and a compression spring 119 mounted between a retaining ring 118 fitted in an inner surface of the valve chamber 116 near the outer end and the valve sphere 117. The relief valve 130 is adapted to open when the hydraulic pressure in the bypass port 102 exceeds a given level determined by the spring force of the spring 119.

With this embodiment, When the selector valve 69 is in a closed state, the oil feed passages 58*i*, 58*e* communicate with the bypass port 102 and as the hydraulic pressure in the bypass port 102 exceeds a given value, the relief valve 130 opens. This causes the hydraulic pressure in the oil feed passages 58*i*, 58*e* to escape through the bypass port 102 and the relief valve 130 into the working chamber 15, so that the hydraulic pressure in the oil feed passages 58*i*, 58*e* and thus in the hydraulic chamber 56 in the operation mode changing mechanisms 26*i*, 26*e* is rapidly reduced, leading to an improvement in the speed of response in the change-over from the higher-speed operation mode to the lower-speed operation mode. Moreover, because the relief valve 130 closes when the hydraulic pressure in the bypass port 102 and thus in the oil feed passages 58*i*, 58*e* is reduced to a predetermined level depending on spring 119, the hydraulic pressure in the oil feed passages 58*i*, 58*e* does not drop to zero but rather is maintained at a constant lower level. Therefore, when the hydraulic pressure is again supplied into the oil feed passages 58*i*, 58*e* to increase the hydraulic pressure therein for a change-over to the higher-speed mode of operation, a higher hydraulic pressure condition can be achieved quickly, thereby resulting in an improvement in the speed of response.

What is claimed is:

1. A valve operating system for an internal combustion engine, including a valve operation mode changing mechanism capable of changing at least one of either the lift amount of opening of an engine valve openably and closably carried in an engine body or the opening or closing timing in accordance with a variation in hydraulic pressure supplied to the changing mechanism, and a selector valve including a valve element slidably received in a housing attached to the engine body to change the supply of hydraulic pressure to the valve operation mode changing mechanism, wherein the housing of the selector valve is provided with a working oil chamber in communication with the valve element for driving the valve element, toward a position to supply a higher hydraulic pressure to the valve operation mode changing mechanism upon an increase in oil pressure in said working oil chamber, the valve element biased toward a position to supply a lower hydraulic pressure to the valve operation mode changing mechanism, said working oil chamber being connected through a leak jet to a drain chamber provided in the engine body.

2. A valve operating system for an internal combustion engine according to claim 1, further including an open chamber defined between the housing of the selector valve and the engine body to lead to the drain chamber, and wherein said leak jet is provided in the housing and opens into said open chamber.

3. A valve operating system for an internal combustion engine, including a valve operation mode changing mechanism capable of changing at least one of either the lift amount of opening of an engine valve openably and closably carried in an engine body or the opening or closing timing in accordance with a variation in hydraulic pressure supplied to the changing mechanism, and a selector valve including a valve element slidably received in a housing attached to the engine body to change the supply of hydraulic pressure to the valve operation mode changing mechanism, wherein the housing of the selector valve has an inlet port provided therein communicating with a hydraulic pressure supply source, said inlet port being selectively opened and closed by the valve element, and an oil filter disposed in the inlet port and clamped between the housing and the engine body.

4. A valve operating system for an internal combustion engine, including a valve operation mode changing mechanism capable of changing at least one of either the lift amount of opening of an engine valve openably and closably carried in an engine body or the opening or closing timing in accordance with a variation in hydraulic pressure supplied to the changing mechanism, and a selector valve including a valve element slidably received in a housing attached to the engine body to change the supply of hydraulic pressure to the valve operation mode changing mechanism, wherein the housing of the selector valve includes an inlet port communicating with a hydraulic pressure supply source, an outlet port communicating with the valve operation mode changing mechanism, said inlet and outlet ports being provided in the housing in a manner such that the communication between said inlet and outlet ports is changed over by the movement of the valve element, an oil reservoir provided at the opposite side from the outlet port with respect to the valve element and in communication with the outlet port, and a pressure detector attached to the housing and in communication with said oil reservoir.

5. A valve operating system for an internal combustion engine, including a valve operation mode changing mechanism capable of changing at least one of either the lift amount of opening of an engine valve openably and closably carried in an engine body or the opening or closing timing in accordance with a variation in hydraulic pressure supplied to the changing mechanism, and a selector valve including a valve element slidably received in a housing attached to the engine body to change the supply of hydraulic pressure to the valve operation mode changing mechanism, wherein the housing of the selector valve includes an inlet port communicating with a hydraulic pressure supply source, an outlet port communicating with the valve operation mode changing mechanism, said inlet and outlet ports being provided in the housing in a manner such that the communication between said inlet and outlet ports is changed over by the movement of the valve element, and a bypass port provided in the housing for selectively connecting a drain chamber provided in the engine body with the outlet port.

6. A valve operating system for an internal combustion engine according to claim 5, further including an open chamber defined between the housing of the selector valve and the engine body for communicating with the drain chamber, and wherein a leak jet is provided in the housing and opened into said open chamber for releasing hydraulic pressure on the valve element.

7. A valve operating system for an internal combustion engine according to claim 5 or 6, further including a relief valve provided in said bypass port and adapted to be opened when the hydraulic pressure in the outlet port is more than a predetermined value.

8. A valve operating system for an internal combustion engine according to claim 5 or 6, wherein said bypass port is provided in the housing at location for being closed by the valve element when the valve element is in a position to put the inlet and outlet ports in communication with each other.

9. A valve operating system for an internal combustion engine according to claim 8, further including a relief valve provided in said bypass port and adapted to be opened when the hydraulic pressure in the outlet port is more than a predetermined value.

10. A valve operating system for an internal combustion engine, including a valve operation mode changing mechanism capable of changing at least one of either the lift amount of opening of an engine valve openably and closably carried in an engine body or the opening or closing timing in accordance with a variation in hydraulic pressure supplied to the changing mechanism, and a selector valve including a valve element slidably received in a housing attached to the engine body to change the supply of hydraulic pressure to the valve operation mode changing mechanism, wherein the clearance distance d between an inner surface of a cylinder bore provided in the housing for slidably receiving the valve element therein and an outer surface of the valve element is set to establish a relation: $d/D=0.75$ to $7\times10^{-3}$ wherein D is an outside diameter of the outer surface of the valve element.

11. A valve operating system for an internal combustion engine, including a valve operation mode changing mechanism capable of changing at least one of either the lift amount of opening of an engine valve openably and closably carried in an engine body or the opening or closing timing in accordance with a variation in hydraulic pressure supplied to the changing mechanism, and a selector valve including a valve element slidably received in a housing attached to the engine body to change the supply of hydraulic pressure to the valve operation mode changing mechanism, wherein said housing of the selector valve is formed of a material having a coefficient of thermal expansion larger than a coefficient of thermal expansion of a material forming the valve element.

12. A valve operating system for an internal combustion engine, including a valve operation mode changing mechanism capable of changing at least one of either the lift amount of opening of an engine valve openably and closably carried in an engine body or the opening or closing timing in accordance with a variation in hydraulic pressure supplied to the changing mechanism, and a selector valve including a valve element slidably received in a housing attached to the engine body to change the supply of hydraulic pressure to the valve operation mode changing mechanism, wherein said selector valve is interposed between a hydraulic pressure supply passage leading from a hydraulic pressure supply source and an oil feed passage leading to the valve operation mode changing mechanism, the hydraulic pressure supply passage has a passage portion substantially horizontally formed in a member of the engine body, and said passage portion is comprised of a larger diameter portion leading to the hydraulic pressure supply source and a smaller diameter portion through a step and leading to the selector valve, said larger diameter portion within the hydraulic pressure supply passage forming an accumulator means.

13. A valve operating system according to claim 12, wherein the housing includes an inlet port communicating with a hydraulic pressure supply source, an outlet port in communication with the valve operation mode changing mechanism, said inlet and outlet ports being provided in the housing in a manner such that communication therebetween is controlled by movement of the valve element, and a bypass port provided in the housing for selectively connecting the outlet port with a drain chamber in the engine body.

14. A valve operating system according to claim 13, wherein a pressure detector is connected to the housing in communication with the outlet port for detecting the actual position of the valve element.

15. A valve operating system according to claim 14, wherein a filter is disposed in the inlet port and clamped between the housing and engine body.

16. A valve operating system for an internal combustion engine, including a valve operation mode changing mechanism capable of changing at least one of either the lift amount of opening of an engine valve openably and closably carried in an engine body or the opening or closing timing in accordance with a variation in hydraulic pressure supplied to the changing mechanism, and a selector valve including a valve element slidably received in a housing attached to the engine body to change the supply of hydraulic pressure to the valve operation mode changing mechanism, wherein said selector valve is interposed between a hydraulic pressure supply passage leading from a hydraulic pressure supply source and an oil feed passage leading to the valve operation mode changing mechanism, and an enlarged portion is provided within the hydraulic pressure supply passage for forming an accumulator means, wherein the clearance distance d between an inner surface of a cylinder bore provided in the housing for slidably receiving the valve element and an outer surface of the valve element is set to establish a relation of $d/D=0.75$ to $7\times10^{-3}$ wherein D is an outside diameter of the outer surface of the valve element.

17. A valve operating system according to claim 16 wherein the housing includes an inlet port communicating with a hydraulic pressure supply source, an outlet port in communication with the valve operation mode changing mechanism, said inlet and outlet ports being provided in the housing in a manner such that communication therebetween is controlled by movement of the valve element, and a bypass port provided in the housing for selectively connecting the outlet port with a drain chamber in the engine body.

18. A valve operating system according to claim 17 wherein a pressure detector is connected to the housing in communication with the outlet port or detecting the actual position of the valve element.

19. A valve operating system according to claim 18 wherein a filter is disposed in the inlet port and clamped between the housing and the engine body.

20. A valve operating system according to claims 3, 4, 5, 10, 11, 12, 16, 17, 18, 19, 13, 14 or 15 wherein the housing is provided with a working oil chamber in communication with the valve element for driving the valve element toward a position to supply a higher hydraulic pressure to the valve operation mode changing mechanism upon an increase in oil pressure in said working oil chamber, the valve element being biased toward a position to supply a lower hydraulic pressure to the valve operation mode changing mechanism, and said working oil chamber being connected through a leak jet to a drain chamber in the engine body.

* * * * *